United States Patent [19]

Tsubota et al.

[11] 4,069,048

[45] Jan. 17, 1978

[54] DIFFUSION TRANSFER PHOTOGRAPHIC MATERIALS WITH COLOR DEVELOPER SCAVENGER

[75] Inventors: Motohiko Tsubota; Sosuke Hanai; Yasushi Oishi; Hidefumi Sera; Nobuo Yamamoto, all of Minami-ashigara, Japan

[73] Assignee: Fuji Photo Film Co., Ltd., Minami-ashigara, Japan

[21] Appl. No.: 658,939

[22] Filed: Feb. 17, 1976

[30] Foreign Application Priority Data

Feb. 17, 1975 Japan ..... 50-19554

[51] Int. Cl.[2] ..... G03C 7/00; G03C 5/54; G03C 1/40; G03C 1/76

[52] U.S. Cl. ..... 96/3; 96/29 D; 96/56; 96/74; 96/77

[58] Field of Search ..... 96/29 D, 3, 76 R, 77, 96/56, 95, 74

[56] References Cited

U.S. PATENT DOCUMENTS

| | | | |
|---|---|---|---|
| 3,459,548 | 8/1969 | Bloom et al. | 96/77 |
| 3,725,063 | 4/1973 | Wolfarth et al. | 96/77 |
| 3,730,713 | 5/1973 | Abbott et al. | 96/77 |
| 3,743,504 | 7/1973 | Pappen et al. | 96/56 |
| 3,779,756 | 12/1973 | Farran et al. | 96/29 D |

*Primary Examiner*—David Klein
*Assistant Examiner*—Richard C. Schilling
*Attorney, Agent, or Firm*—Sughrue, Rothwell, Mion, Zinn, and Macpeak

[57] ABSTRACT

In a diffusion transfer color photographic material including a photosensitive element comprising silver halide emulsion layers having associated therewith dye image forming materials, an image receiving element, and a liquid processing composition for developing the silver halide emulsion layers after image-wise exposure and diffusing the dye images formed into the image receiving element, the dye images formed are stabilized and the formation of stains at blank areas is effectively prevented by incorporating one or more N-α-sulfoalkylated amino acids into at least one of the photosensitive element, the image receiving element or the liquid processing composition. A process using the same is also disclosed.

38 Claims, No Drawings

DIFFUSION TRANSFER PHOTOGRAPHIC MATERIALS WITH COLOR DEVELOPER SCAVENGER

BACKGROUND OF THE INVENTION

1. Field of the Invention

The present invention relates to a diffusion transfer color photographic material, more particularly, to a color photographic material for a diffusion transfer process using a primary aromatic amino color developing agent and to process therefor.

2. Description of the Prior Art

Color photographic materials for a diffusion transfer process using a primary aromatic amino color developing agent are disclosed in many patents and patent applications as shown below, and dye image forming processes, dye image providing materials, layer structures, and layer arrangements are well known, and in any case dye images are formed by the reaction of the dye image providing materials and the oxidation product of a primary aromatic amino color developing agent. In such a color diffusion transfer process, it is necessary that the dye image be stable, that is, whether the photosensitive element is separated or not from the image receiving element after the dye images formed are transferred to the image receiving element, the dye images formed in the image receiving element are very unstable when processing composition remains in the spread state therein, and the dye images are usually faded or blank areas, that is, areas to which dye images were not transferred are stained with the passage of time.

A few techniques for improving the aforementioned faults in the color development have been reported. For instance, Japanese Patent Application (OPI) 5424/1973 teaches that the addition of an aldehyde-bisulfite addition product is effective to prevent the formation of stains in the blank areas. It is believed that the additive reacts with excessive primary aromatic amino color developing agent remaining (which has not been used in the development) to form a colorless product so that the formation of yellowish-brown stains caused by the diffusion of unreacted primary aromatic amino color developing agent into the image receiving element is reduced. Also, Japanese Patent Application (OPI) 15,134/1972 teaches that the addition of an isocyanate-bisulfite addition product to a polymer binder is effective to prevent the formation of stains in blank areas. It is believed that the formation of stains is presented by the same action as above. Furthermore, Japanese Patent Application (OPI) 3836/1973 teaches that the addition of a bis(vinylsulfonylalkyl) derivative or a polymer thereof is also effective for the aforesaid purpose, and in this case it is also believed that the formation of stains is restrained by the same action as above.

As mentioned above, the addition of an aldehyde-bisulfite addition product, an isocyanate-bisulfite addition product, a bis(vinylsulfonylalkyl) derivative or the polymer thereof may be effective to prevent stains in blank areas, but the addition of the aforesaid materials has a low effect for the prevention of fading of dye images.

Furthermore, the stabilization of dye images is generally very important in color photographic materials for a diffusion transfer process using a primary aromatic amino color developing agent, that is, in general color photography a developing solution (it is well known that the solution has a bad influence on the stabilization of dye images) is supplied to an exposed photosensitive element from a processing bath such as an automatic developing machine but is removed therefrom in a post treatment such as fix, wash, bleach, etc., after development. That is, in general color photography operations which are preferred for the stabilization of color images are employed but in a diffusion transfer color photographic system the processing composition is left on the image bearing image receiving element after development, and thus, as will be easily understood, the color images formed become unstable.

SUMMARY OF THE INVENTION

One object of this invention is, therefore, to provide a diffusion transfer color photographic material in which the above-described various faults are improved and an additive possessing the effect of reducing the formation of stains in the blank portions is used.

Another object of this invention is to provide a diffusion transfer color photographic material capable of providing dye images which are stabilized and wherein fading is prevented.

Still another object of this invention is to provide a diffusion transfer color photographic material which is processed by a primary aromatic amino color developing agent in the presence of a compound which stabilizes dye images formed and prevents the formation of stains at blank areas.

A further object of this invention is to provide a diffusion transfer color photographic material in which the dye images formed in the image receiving element and/or the photosensitive element are stabilized and the formation of stains is prevented.

As a result of various inventigations, the inventors have discovered that the above mentioned various objects of this invention are attained according to the present invention, i.e., there is provided a diffusion transfer color photographic material which comprises, in combination, a photosensitive element comprising at least one silver halide emulsion layer having associated therewith a non-diffusible dye image forming material; an image receiveng element which receives and fixes the diffusible dye formed from the dye image forming material by oxidative reaction with a primary aromatic amino color developing agent to form a dye image; and a liquid processing composition which develops the photosensitive element and transfers the dye image formed in the photosensitive element to the image receiving element; wherein one or more of the photosensitive element, the image receiving element or the liquid processing composition contains one or more N-α-sulfoalkylated amino acids. The process of using the same is also set forth.

DESCRIPTION OF THE PREFERRED EMBODIMENTS

It was found that by the practice of this invention as described above stains at blank areas of the color photographs obtained were improved and also that fading of the color images was greatly improved. That is, the diffusion transfer color photographic material of this invention has an excellent effect at the point of stabilization of color images, which has never been obtained by conventional photographic materials of this type, and the invention is a very effective technique for producing diffusion transfer color photographic materials using a primary aromatic amino color developing agent and for practically using these photographic materials.

The reason for obtaining the remarkable effects in this invention has not yet been completely clarified, but is believed to be as follows: That is, after the primary aromatic amino color developing agent is used at the development of the exposed color photographic material, remaining oxidation product of the color developing agent (which was not consumed in the formation of color images at development) reacts with the N-α-sulfoalkylated amino acid of this invention present in the system to form a harmless compound, the reaction probably involving the amino group of the color developing agent and a carbonyl group-containing compound released from the N-α-sulfoalkylated amino acid during or after development. Phrased differently, it is believed that the N-α-sulfoalkylated amino acid acts as a precursor for a scavenger as described above. At any event, the effects due to the N-α-sulfoalkylated amino acid of this invention are astonishing, and would never be expected by one skilled in the art.

The N-α-sulfoalkylated amino acid or acids (hereafter the singular is used for purposes of brevity) used in this invention can be represented by general formula (I):

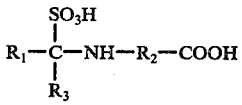

(I)

wherein $R_1$ represents a hydrogen atom; hydroxy group, an aliphatic hydrocarbon group having 1 to 22 carbon atoms (e.g., an alkyl group such as methyl group, ethyl group, propyl group, isopropyl group, n-butyl group, and dodecyl group; a substituted alkyl group having 1 to 22 carbon atoms such as an alkyl group substituted by a hydroxy group, acyl group derived from a carboxylic acid (preferably of 1 to 5 carbon atoms, though such is not limitative), acylamino group (preferably of 1 to 5 carbon atoms, though such is not limitative), carboxy group, sulfo group, amino group, alkoxy group (preferably of 1 to 5 carbon atoms, though such is not limitative), allyloxy group, carbamoyl group, sulfamoyl group, fluorine atom, acyloxy group (preferably of 1 to 5 carbon atoms, though such is not limitative), alkoxycarbonyl group (preferably of 1 to 5 carbon atoms, though such is not limitative), alkylthio group (preferably of 1 to 5 carbon atoms, though such is not limitative), arylthio group (preferably a monoarylthio group), alkylsulfinyl group (preferably of 1 to 5 carbon atoms, though such is not limitative), sulfino group, alkylsulfonyl group (preferably of 1 to 5 carbon atoms, though such is not limitative), mercapto group, or aryl group (preferably a monoaryl group); and an alkenyl group having 1 to 22 carbon atoms such as an allyl group and a substituted alkenyl group), an alicyclic hydrocarbon group (e.g., a 3- to 6-membered alicyclic hydrocarbon group such as cyclohexyl group), an aromatic hydrocarbon group having 6 to 14 carbon atoms (e.g., a monocyclic ring, a polycyclic ring, or a condensed ring aryl group, said aryl group being unsubstituted or substituted by an alkyl group, nitro group, cyano group, ureido group, hydroxy group, acyl group, acylamino group, carboxy group, sulfo group, amino group, alkoxy group, allyloxy group, halogen atom, carbamoyl group, sulfamoyl group, acyloxy group, alkoxycarbonyl group, alkylthio group, or arylthio group), or a heterocyclic group; $R_2$ represents an alkylene group (e.g., an unsubstituted alkylene group and an alkylene group substituted by lower alkyl group, hydroxyalkyl group, alkoxyalkyl group, aralkyl group, or aryl group) or an arylene group (e.g., an unsubstituted phenylene group, an unsubstituted naphthylene group and a phenylene group or naphthylene group substituted by a lower alkyl group, halogen atom, nitro group, lower alkoxy group, acylamino group, sulfo group, or carboxy group); and $R_3$ represents a hydrogen atom; an alkyl group which may have been substituted by hydroxy group, alkoxy group, allyloxy group, sulfo group, carboxy group, amino group, or substituted amino group, for example, substituted with an alkyl group having 1 to 5 carbon atoms or an aryl group such as a phenyl group, or an aryl group which may be substituted, if desired, for example, with a halogen atom such as chlorine or bromine; an alkoxy group having 1 to 5 carbon atoms; or an alkyl group having 1 to 5 carbon atoms.

Preferred examples of the N-α-sulfoalkylated amino acids of this invention are represented by general formula (II):

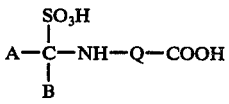

(II)

wherein A represents a hydrogen atom, a hydroxy group, a lower alkyl group having 1 to 5 carbon atoms, a suubstituted alkyl group wherein the alkyl moiety has 1 to 5 carbon atoms (examples of the substituent are a hydroxy group, lower alkoxy group, etc.), an alicyclic hydrocarbon group (e.g., cyclohexyl group, etc.), an aryl group (e.g., phenyl group, etc.), or a substituted aryl group substituted by, e.g., a lower alkyl group, nitro group, cyano group, alkoxy group, sulfo group, allyloxy group, halogen atom, acyloxy group, alkoxycarbonyl group, etc.; B represents a hydrogen atom or the group shown by

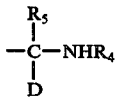

(wherein $R_4$ represents a hydrogen atom, an alkyl group, or an aryl group which may have a substituent such as sulfo group, carboxy group, etc.; $R_5$ represents a hydrogen atom or a lower alkyl group; and D represents a hydrogen atom or a sulfo group); and Q represents a methylene group, a substituted methylene group having a substituent such as lower alkyl group, hydroxyalkyl group, lower alkoxyalkyl group, aralkyl group, and aryl group, a phenylene group, or a substituted phenylene group having a substituent (such as lower alkyl group, halogen atom, nitro group, lower alkoxy group, sulfo group, carboxyl group, etc.).

Of these compounds, compounds 1 to 5 as exemplified below are particularly preferred.

Examples of the compounds of this invention are as follows:

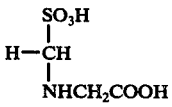

1.

-continued

2.

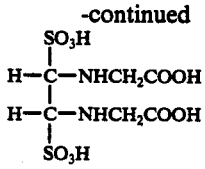

3.

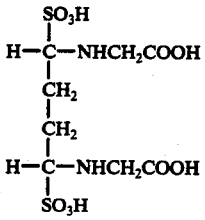

4.

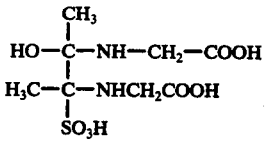

5.

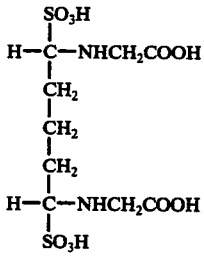

6.

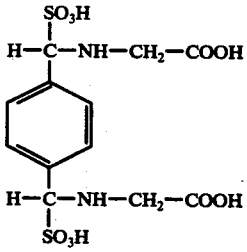

7.

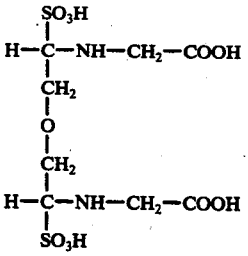

8.

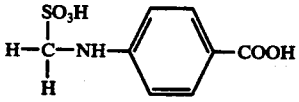

9.

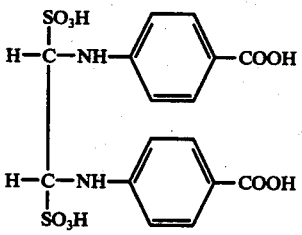

-continued

10.

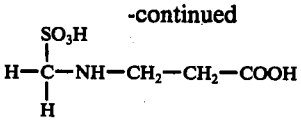

11.

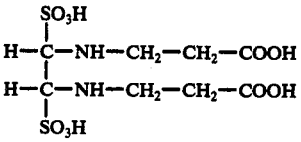

12.

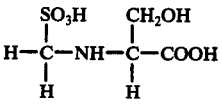

13.

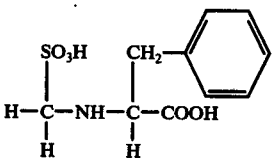

14.

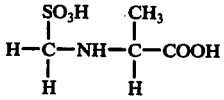

15.

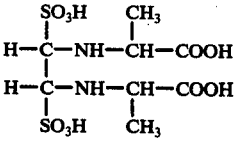

16.

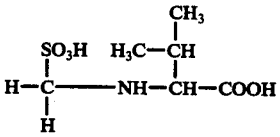

The N-α-sulfoalkylated amino acids of this invention can be easily prepared by applying various known α-sulfoalkylation reactions for the amino group of an amino acid. For example, it is preferred to employ the method described in D. N. Engles, Chemistry and Industry, 1492 - 1493 (1967), but furthermore there may be employed sulfomethylation using formalin and sulfurous acid gas (or a hydrogen sulfite or a sulfite) as described in U.S. Pat. No. 2,721,875; Journal of Organic Chemistry, Vol. 27, 1881 to 1882 (1962); and Journal of the Chemical Society of Japan, Industrial Chemistry Section, Vol. 55, 782 to 876 (1952). Moreover, the compounds of this invention can further be prepared by other known methods.

Typical examples of producing the compounds of this invention are illustrated below but the invention is not limited thereto.

Synthesis Example 1

Production of N-sulfomethylene (Compound 1) of the formula:

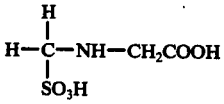

After mixing 75 g of glycine, 81 g of a 37 wt% aqueous formaldehyde solution, and 20 ml of water, $SO_2$ gas was blown into the mixture while stirring at room temperature to complete the formation of white precipitates. Reaction occurred with the generation of a slight amount of heat to provide a homogeneous solution. When excess $SO_2$ gas was passed into the solution (an amount greater than absorbing capacity of the reaction solution), the white precipitates formed which were recovered by filtration and dried to provide white crystals of a melting point of 140° C with a yield of 105 g.

Elementary Analysis: Calculated: C 21.30%; H 4.18%; N 8.28%; Found: C 21.15%; H 4.28%; N 8.15%.

Synthesis Example 2

Production of N,N'-(vicinal-disulfoethylene)bisglycine (Compound 2) of the formula:

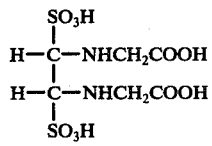

A mixture of 75 g of glycine, 72 g of an aqueous 40 wt% glyoxal solution, and 40 ml of water was reacted with $SO_2$ gas as in Synthesis Example 1 to provide 89 g of white crystals having a melting point of 130° C.

Elementary Analysis: Calculated: C 21.43%; H 3.57%; N 8.33%; Found: C 21.16%; H 3.82%; N 8.20%.

It is preferred that the compound of this invention be coated at a coverage of at least about $10^{-3}$ mol/m$^2$. This amount corresponds to about the equimolar amount or more than the amount of primary aromatic amino color developing agent present in the photographic system after the initiation of development, that is, at the initiation of development, a liquid processing composition is usually coated so that about $10^{-3}$ mol/m$^2$ of the primary aromatic amino color developing agent is present and thus it is preferred that the compound of this invention be used in an amount of about $10^{-3}$ mol/m$^2$ to about $10^2$ mol/m$^2$, in particular, about $10^{-2}$ mol/m$^2$ to about $10^1$ mol/m$^2$.

The compound of this invention may be incorporated in one or more of the photosensitive element, the liquid processing composition or the image receiving element of the diffusion transfer color photographic material, but it is required that the residue of the primary aromatic amino color developing agent after finishing the development be scavenged and inactivated by the compound of this invention. Therefore, it is preferred to add the compound of this invention to a position where the compound acts as a scavenger after the development of the photosensitive element in a sufficient amount. For instance, it is preferred to incorporate the composition of this invention in the aforesaid image receiving element of the color photographic material so it is present at the side remote from the photosensitive element in the direction of the impregnation of the liquid processing composition. Furthermore, the compound of this invention may be encapsulated and incorporated in the photosensitive element as microcapsules. For instance, such microcapsules containing the compound of this invention are not easily ruptured when they are brought into contact with the liquid processing composition and thus by using a molecular sieve type polymer as described in U.S. Pat. Nos. 3,421,892, 3,625,685, and 3,421,892, the compound of this invention can be incorporated in the photosensitive element as microcapsules of the compound.

When the compound of this invention is incorporated in the image receiving element, it may, as a matter of course, be incorporated in at least one of the image receiving layer, the neutralization speed controlling layer, and the neutralization layer of the image receiving element. In this case, further, it is possible to form an additional layer in the image receiving element and the compound of this invention can be incorporated in such an additional layer.

The dye image forming material used in this invention is a non-diffusible compound which provides a two dimensional distribution of a diffusible dye corresponding to the image exposure as the result of the development of the silver halide emulsion layer subjected to the image-wise exposure. There are dye image forming materials based on various systems of inducing the formation of diffusible dyes by the development of silver halide. For instance, there are the types in which oxidation by silver halide relates directly to the formation of diffusible dyes, such as: (i) a type where the dye image forming agent is converted into a diffusible dye as a result of being oxidized by silver halide; (i) a type where a product oxidized by a silver halide is reacted with a dye image forming agent to release a diffusible dye; (iii) a type where an oxidized dye image forming material is reacted with an auxiliary agent to release a diffusble dye, etc., as well as types where images of diffusible dyes are formed by the components remaining without being consumed in the development and the subsequent reaction occurring together with the development, such as (iv) a type where a limited amount of a developing agent is used and the developing agent which was not used in the development is transferred into an image receiving element to form a dye therein; (v) a type where a limited amount of a developing agent is used and the developing agent which was not used in the development is reacted with a dye image forming material to form a diffusible dye; (vi) a type where a limited amount of a reactive component which causes reaction with the oxidation product of a primary aromatic amino color developing agent, such as a coupler, is used and the reactive component which was not used in the reaction subsequent to the development is transferred into an image receiving layer to form a dye therein; and (vii) a type where silver ion obtained from the silver halide which was not used in the development is reacted with a dye image forming material to form a diffusible dye. Furthermore, there is a system in which a mordant is formed or destroyed around silver halide grains by development of the silver halide grains, whereby a diffusible dye is fixed or released.

The dye image forming material used in the diffusion transfer color photography of this invention may be of the type wherein the dye image forming material contains a dye structure portion, the type wherein a dye structure is formed in the dye image forming material in development and a subsequent reaction step together with the development, or the type wherein a component necessary for the formation of a dye is transferred into an image receiving layer to form a dye therein.

It is preferred that the dye image forming material itself which is used in the diffusion transfer color photography of this invention be non-diffusible in the photosensitive element thereof during the production of the color photographic material and in the steps of storage and exposure thereof but that the material can have various diffusibilities according to the systems of forming dye image distributions in the steps of development and diffusion transfer. For instance, in one embodiment of the diffusible type, the dye image forming material is soluble and diffusible in a liquid processing composition but, as the result of development, the dye image forming material is reduced in diffusibility and is fixed while the undeveloped dye image forming material is transferred into an image receiving layer. In another embodiment, the dye image forming material itself is non-diffusible in a liquid processing composition but, as the result of development, the dye image forming material releases a diffusible dye or a precursor of a diffusible dye.

In this invention, dye image forming materials as mentioned above can be employed but particularly useful materials are as follows:

Diffusible dye releasing coupler:

The coupler is a reactive non-diffusible compound which undergoes a coupling reaction with an oxidized primary aromatic amino color developing agent and releases, as the result of development, a dye which is soluble and diffusible in a liquid developing composition. A first type of diffusible dye releasing coupler includes a structure where the coupling reaction point is substituted by a residue which is released by the oxidized primary aromatic amino color developing agent. The conjugated electron system of the releasing dye may be associated beforehand in the coupler or may be formed by the coupling reaction as is disclosed in U.S. Pat. No. 3,227,550. The former can referred to as "an existing type" and the coupler shows a spectral absorption similar to that of the released dye while the latter can be referred to as "instantly formed type" and the absorption of the coupler (which may be colorless or colored) has no direct relationship to the absorption of the released dye.

Typical examples of diffusible dye releasing couplers can be shown by the following general formulae:

(1) $(C_{p-1})$—L—(Fr) — (Existing type)

(2) $(C_{p-2})$—L—(Bl) — (Instantly formed type)

wherein $C_{p-1}$ represents a coupling reactive structure portion the coupling position of which is substituted by a (Fr)—L-residue wherein at least one non-coupling position contains a hydrophobic group having more than 8 carbon atoms and which is substituted with a group capable of providing diffusibility to the couplers molecule; $C_{p-2}$ represents a coupling reactive structure portion the coupling position of which is substituted by a (Bl)—L- residue, and, further, when the coupler is used in combination with a developing agent having no water solubilizing group, the $C_{p-2}$ group has at least one water solubilizing group at a non-coupling position; the (Fr)—L-group and the (Bl)—L-group each represents a group which is released by the oxidized developing agent; Fr represents a dye structure portion having an absorption in the visible wavelength region and at least one water solubilizing group; and Bl represents a group containing a hydrophobic group of more than 8 carbon atoms which provides diffusibility to the coupler molecule.

As coupling reactive structure portions shown by $C_{p-1}$ and $C_{p-2}$, there can be illustrated many functional groups which are known to be able to undergo oxidative coupling with a primary aromatic amino color developing agent. For instance, there are phenols, anilines, active methylene compounds, and hydrazones. Practical examples of particularly useful reactive structure portions are acylamino group-substituted phenols; 1-hydroxy-2-naphthoic acid; N,N-dialkylaniline; 1-aryl-5-pyrazolones the 3-position of which is substituted by an alkyl group, aryl group, alkoxy group, aryloxy group, amino group, acylamino group, ureido group, or sulfonamido group; pyrazolo benzimidazoles; pyrazolotriazoles; α-cyanoacetophenone; and the residue derived from α-acylacetanilide (see U.S. Pat. Nos. 3,227,551, 3,227,552, and 3,227,554).

As the linkage group L which is split by the oxidized developing agent, there can be illustrated an azoxy group, mercury (-Hg-), an oxy group, a thio group, a dithio group, a triazolyl group, a diacylamino group, an acylsulfonamino group

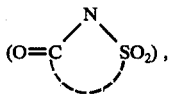

an acyloxy group, a sulfonyloxy group, and an alkylidene group.

Among the aforesaid groups, an oxy group, a thio group, a dithio group a diacylamino group, an acyloxy group, etc., which are released as an anion are particularly useful as the proportion of the released diffusible dye is large. Furthermore, it is preferred that the coupling position of the coupling structure of a phenol or naphthol coupler have a substituent which is bonded through an oxy group, a thio group, or a diacyloxy group. Also, it is preferred that the coupling position of a pyrazolone coupler be substituted by an azo group, a thio group, an acyloxy group, and the coupling position of an acylacetoanilide coupler be substituted by an oxy group, a thio group, or a diacylamino group.

Typical examples of the dye structure portion shown by Fr are the residues derived from azo dyes, azomethine dyes, indoaniline dye, indophenol dyes, anthraquinone dyes, nitro dyes, azine dyes, etc.

The hydrophobic residue contained in the residue shown be $C_{p-1}$ and Bl provides a cohesive force to coupler molecules in an aqueous medium to render the couplers non-diffusible in a hydrophilic colloid constituting the photographic materials. As such hydrophobic residues, an unsubstituted or substituted alkyl group having at least 8 carbon atoms, an alkenyl group, an aralkyl group, and an alkylaryl group can be advantageously used. Practical examples of these groups are a lauryl group, a stearyl group, an oleyl group, a 3-n-pentadecylphenyl group, a 2,4-di-t-amylphenoxy group, etc. The hydrophobic residue is bonded to the fundamental structure portion of the coupler directly or through a divalent linkage such as an amide linkage, a ureido linkage, an ether linkage, an ester linkage, or a sulfonamido linkage to form $C_{p-1}$ or is bonded to a residue such as an aryl group or a heterocyclic group through the abovementioned linkage to form Bl. For example, in the case of general formula (1), $C_{p-1}$ = coupler skeleton-(divalent bond)-hydrophobic residue; and in the case of general formula (2), Bl = —Z—(divalent bond)-hydrophobic residue where Z is an aromatic ring or heterocyclic ring.

The water solubilizing group contained in the residue shown by $C_{p-1}$ or Fr is an acid group which substantially dissociates in a liquid processing composition or a precursor giving such an acid group by hydrolysis. An acid group having a pKA lower than 11 is particularly useful. Examples of such an acid group are a sulfo group, a sulfuric acid ester group (—O—$SO_3H$), a carboxyl group, a sulfonamide group, a diacylamino group, a cyanosulfonamino group, a phenyl group having a hydroxyl group, etc.

When a diffusible dye releasing coupler of the type shown by general formula (1) is reacted with an oxidized primary aromatic amino color developing agent, the linkage L is cleaved to form a non-diffusible condensation product of $C_{p-1}$ and the developing agent and a soluble dye containing the Fr structure portion. The soluble dye thus formed transfers into an image receiving layer to form a dye image therein.

On the other hand, when a diffusible dye releasing coupler of the type shown by general formula (2) is reacted with an oxidized primary aromatic amino color developing agent, the linkage L is cleaved to provide a soluble dye which is the oxidative coupling product of $C_{p-2}$ and the developing agent and a non-diffusible released product generated from Bl. The soluble dye transfers by diffusion into an image receiving layer to form a dye image there.

Specific examples of diffusible dye releasing couplers of the type shown by formula (1) are as follows:

α-[4-(8-acetamido-3,6-disulfo-1-hydroxy-2-naphthylazo)-phenoxy]-α-pivalyl-4-(N-methyl-N-octadecylsulfamyl)acetanilide.disodium salt, 1-(p-t-butylphenoxyphenyl)-3-[α-(4-t-butylphenoxy)-propionamido]-4-(2-bromo-4-methylamino-5-sulfo-1-anthra-9,10-quinolylazo)-5-pyrazolone, and 1-hydrox-4-{3-[4-(N-β-sulfoethylamino)-2-methylphenylazo]phenylazo}-N-[δ-(2,4-di-t-amylphenoxy)butyl]-2-naphthamide. sodium salt.

Specific examples of the diffusible dye releasing coupler of the type shown by formula (2) include the following couplers:

α-(4-methoxypbenzoyl)-α-(3-octadecylcarbamylphenylthio)-3,5-dicarboxyacetanilide, α-pivalyl-α-(3-octadecylcarbamylphenylthio-4-sulfoacetanilide.potassium salt, 1-phenyl-3-(3,5-dicarboxyanilino)-4-(3-octadecylcarbamylphenylthio)-5-pyrazolone, 1-phenyl-3-(3,5-disulfobenzoylamino)-5-(2-hydroxy-4-n-pentadecylphenylazo)-5-pyrazolone, 1-[4-(3,5-dicarboxybenzamido)phenyl]-3-hydroxy-4-(3-octadecylcarbamylthio)-5-pyrazolone, 1-hydroxy-4-(3-octadecylcarbamylphenylthio)-N-ethyl-3',5'-dicarboxy-2-naphthanilide, and 1-hydroxy-4-(n-octadecylsuccinimido)-N-ethyl-3',5'-dicarboxy-2-naphthanilide.

Other specific examples of such diffusible dye releasing couplers and processes of producing them are described in British Pat. Nos. 840,731, 904,364, and 1,085,631 and U.S. Pat. Nos. 3,476,563, 3,644,498, and 3,419,391.

In a second type compound of diffusible dye releasing coupler, an intramolecular ring closure reaction of a substituent at a position adjacent the reactive point occurs after the condensation reaction of the coupler and an oxidized primary aromatic amino color developing agent, whereby the dye residue contained in the substituent is cleaved and released. In particular, the reaction after oxidative coupling of an aromatic primary amino color developing agent with the 4-position of phenol or aniline coupler where the coupler forms an azine ring with a sulfonamide group contained in the dye structure portion positioned at the 3-position and then releases a diffusible dye having a sulfonic acid group is useful. Specific examples of compounds of this type are as follows:

1-phenyl-3-ethylcarbamoyl-4-{2-methoxy-4-[N-n-dodecylN-(1-hydroxy-4-chloro-3-naphthyl)]sulfamylphenylazo{-5-pyrazolone, and 2-(β-octadecylcarbamoylethyl)-4-{2-[4-(2-hydroxy-1-naphthylazo)phenylsulfoamido]anilino{phenol.

Furthermore, as dye image forming materials which form dye images by reaction with a primary aromatic amino color developing agent, the compounds represented by the following general formulae can be used:

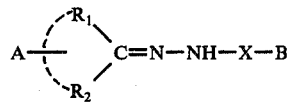

wherein $R_1$ represents a hydrogen atom, an alkyl group (having 1 to 20 carbon atoms), an aryl group, an aralkyl group, or a substituted amino group (substituted by alkyl or aryl group); $R_2$ represents an alkyl group (having 1 to 20 carbon atoms), an aralkyl group, an aryl group, an acyl group generated from an aliphatic carboxylic acid (having 1 to 20 carbon atoms), an aromatic carboxylic acid, or a substituted amino group (as defined for $R_1$); X represents a sulfonyl group, a carbonyl group, or a direct bond between B and NH; A represents a group which renders a compound diffusible which is photographically inactive and contains a dye; and B represents a dye radical or A itself represents a dye or a group forming a dye with $R_2$; and B represents, in this case, a group rendering a compound diffusible which is photographically inactive and which contains a dye, and

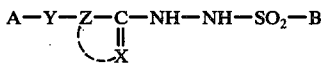

wherein A represents a dye group or a precursor group of such a dye group and B represents an aromatic group; or A represents a ballasting group and B represents a dye group or a precursor group of such a dye group; X represents an oxygen atom, a sulfur atom, or an imino group; Y represents —O—, —S—, —NR—, —CO—, —$SO_2$—, —$SO_2$NH—, or —CONR— (where R is a hydrogen atom or an alkyl group); Z represents a divalent group between Y and the carbon atom to which Z is bonded which may also be bonded to X to form a 5- or 6-membered heterocyclic ring where X is a nitrogen atom.

Specific examples of these compounds are described in British Patent 1,321,046 and Japanese Patent Application (OPI) 64,436/1974.

As primary aromatic amino color developing agents used in association with the diffusible dye releasing coupler, p-aminophenol, p-phenylenediamine and derivatives thereof are advantageously used. Examples of particularly useful developing agents are 2-chloro-4-aminophenol; 2,6-dibromo-4-aminophenol; 4-amino-N,N-diethyl-3-methylaniline; N,N-diethyl-p-phenylenediamine; N-ethyl-β-methanesulfonamidoethyl-3-methyl-4-aminoaniline; 4-amino-N-ethyl-N-(δ-sulfobutyl)aniline; 4-amino-N-ethyl-N-(β-hydroxyethyl-)aniline; 4-amino-3-methyl-N-ethyl-N-(β-hydroxyethyl-)aniline; 4-amino-N-ethyl-N-(β-carboxyethyl)-aniline; 4-amino-N,N-bis(β-hydroxyethyl)-3-methylaniline; 3-acetamido-4-amino-N,N-(β-hydroxyethyl)aniline; 4-amino-N-ethyl-N-(2,3-dihydroxypropyl)-3-methylaniline; 4-amino-N,N-diethyl-3-(3-hydroxypropoxy)aniline; 4-amino-N-ethyl-N-(β-hydroxyethyl)-3-methoxyaniline; and the salts of these anilines with hydrochloric acid, sulfuric acid, oxalic acid, p-toluenesulfonic acid, etc. The developing agent(s) are typically contained in the processing solution in an amount of about 1 to 100 g/l.

Furthermore, the Schiff bases of these anilines, the imides as described in British Pat. Nos. 775,692, 803,783, and 1,069,061, the precursors of these developing agents such as the derivatives as described in U.S. Pat. No. 3,342,597 and British Pat. No. 1,001,473, and the sparingly soluble salts of these developing agents as described in U.S. Pat. No. 3,719,492 are useful since they can be incorporated in the photographic materials.

A negative type silver halide emulsion layer containing a diffusible dye releasing coupler gives a negative diffusion transfer dye image by development while a direct positive type silver halide emulsion layer containing a diffusible dye releasing coupler gives a positive diffusion transfer dye image by development. Examples of useful direct positive emulsions are the internal latent image type emulsions as described in U.S. Pat. Nos. 2,592,250, 2,588,982, and 3,227,552 and the fogged emulsions as described in British Pat. Nos. 443,245 and 462,730 and U.S. Pat. Nos. 2,005,837, 2,541,472, and 3,367,778.

By processing a layer containing a diffusible dye releasing coupler and physical development nuclei formed adjacent a negative type silver halide emulsion layer with a liquid developer containing a silver halide solvent, a positive diffusion transfer dye image can be obtained. The technique as described in British Pat. No. 904,364 can be utilized as a reversal dye image forming technique using physical development nuclei as described above.

Furthermore, a photosensitive element having a layer containing a diffusible dye releasing coupler and a metal salt which can be spontaneously reduced which is formed adjacent a negative type silver halide emulsion layer containing a development inhibitor releasing compound (DIR compound) which releases a development inhibitor, such as 1-phenyl-5-mercaptotetrazole, gives a positive diffusion transfer dye image as described in U.S. Pat. Nos. 3,227,551, 3,227,554 and 3,364,022 and German Offenlegungsschrift 2,032,711.

In this invention, combinations of these silver halide emulsions and dye image forming materials as described above can be used, and, thus, a system providing negative dye images and a system providing positive dye images can be selectively employed according to the desired purpose.

In another embodiment of this invention, a development inhibitor releasing compound (DIR) which is also a dye image forming material can be employed.

The development inhibitor releasing compound (DIR compound) used in this invention is a compound which provides a development inhibitor is a compound which provides, as a function of development, an image-wise distribution of development inhibitor, such as: (1) a coupler which releases a substituent as a development inhibitor from its reactive point upon the coupling reaction thereof with the oxidation product of a primary aromatic amino color developing agent; and (2) a compound which provides a development inhibitor by a secondary reaction with a material formed by development, such as a hydroxide ion or a sulfite ion, in the oxidized state thereof by development. It is required that the DIR compound used in this invention contain in the molecule thereof a hydrophobic group having more than 8 carbon atoms and be non-diffusible. Any hydrophobic groups used in ordinary non-diffusible couplers can be used as the hydrophobic residues in this invention. The releasable group of the DIR coupler may have a chemical structure possessing a development inhibition effect before it is released from the compound or may be of the type which completes the development inhibiting chemical structure after it is released.

Examples of useful development inhibitors are iodine ions, alkylmercaptans, heterocyclic mercaptans, triazoles, imidazoles, and purine nucleus containing compounds. Examples of development inhibitors possessing a particularly high development inhibiting effect are mercaptotriazoles, mercaptotetrazoles, mercaptopyrimidines,. mercaptothiazines, mercaptooxazoles, mercaptoimidazoles, mercaptothiazoles, and benzotriazoles. Specific examples thereof are 4-nitrothiophenol, 2-ethoxycarbonylthiophenol, 1-phenyl-5-mercaptotetrazole, 2-mercaptobenzothiazole, 2-mercapto-4,6,6-trimethylpyrimidine, 5-bromobenztriazole, etc. It is preferred so as to not disturb the development of exposed portions of a photosensitive element that the development inhibitor be present at the reactive position of the DIR compound by linkage through a chemical bond which blocks the development inhibition center (such as, for instance, a carbon bond, a thioether bond, a thioether group-carbon bond, etc.) rather than the development inhibitor be contained in a DIR compound which has a structure possessing the function of inhibiting development.

Examples of DIR couplers or compounds profitably used in this invention are compounds giving a colored coupling product and development inhibitors as described in U.S. Pat. Nos. 3,148,062, 3,227,550, 3,227,551, 3,227,554 and 3,617,291 and compounds giving a colorless coupling product and development inhibitors as described in U.S. Pat. No. 3,632,345.

Specific examples of preferred DIR couplers used in this invention are as follows:

DIRY-1: α-pivaloyl-α-(1-phenyl-5-tetrazolylthio)-2-chloro-5-[γ-(2,4-di-t-amylphenoxy)butyramido]-acetoanilidine, DIRY-2: α-(4-methoxybenzoyl)-α-(1-phenyl-5-tetrazolylthio)-2-chloro-5-[α-(2,4-di-t-amylphenoxy)-butyramido]-acetanilide, DIRY-3: α-benzoyl-α-(1-phenyl-5-tetrazolylthio)-aceto-2-methoxy-5-n-tetradecyloxycarbonylanilide, DIRY-4: α-(p-n-octadecyloxybenzoyl)-α-(5- or 6-bromobenzo-1-benzotriazolyl)aceto-2-methoxyanilide, DIRM-1: 1-{4-[α-(2,4-di-t-amylphenoxy)-butyramido]-phenyl}-3-(1-piperidino)-4-(1-phenyl-5-tetrazolylthio-5-pyrazolone, DIRM-2: 4-(2-benzotriazolyl)-1-(2,4,6-trichlorophenyl)-3-{3-[α-(2,4-di-t-amylphenoxy)acetamido]benzamido}-5-pyrazolone, DIRM-3: 1-benzyl-3-(3-myristoylamino-4-methoxy)-4-(5-bromobenzotriazolyl-1)-5-pyrazolone, DIRC-1: 1-hydroxy-4-(1-phenyl-5-tetrazolylthio)-N-[γ-(2,4-di-t-amylphenoxy)propyl]-2-naphthamide, DIRC-2: 1-hydroxy-4-(2-nitrophenylthio)-N-octadecyl-3′,5′-dicarboxy-2-naphthanilide, DIRC-3: 1-hydroxy-4-(1-phenyl-5-tetrazolyl)-N-(2-chloro-5-n-tetradecyloxycarbonylphenyl)-2-naphthamide, DIRC-4: 1-hydroxy-4-(1-phenyl-5-tetrazolylthio)-N-(2-tetradecyloxyphenyl)-2-naphthamide, and DIRU-1: α-(1-phenyl-5-tetrazolylthio)-2-sulfo-4-n-hexadecyloxyacetophenone.potassium salt.

Moreover, in this invention, development inhibitor releasing hydroquinones can also be used as DIR compounds. They are hydroquinone derivatives which are nucleus substituted by a development inhibitor group as described in U.S. Pat. Nos. 3,297,445, 3,364,022, and 3,379,529. When the hydroquinone derivative is oxidized by development, it releases the development inhibitor by the action of a nucleophilic agent such as hydroxyl ions, sulfite ions, etc., in a liquid processing composition. Specific examples of preferred DIR hydroquinones used in this invention are as follows:

DIRH-1: 2-t-octyl-5-(1-phenyl-5-tetrazolylthio)-hydroquinone,

DIRH-2: 2-n-pentadecyl-5-(1-phenyl-5-tetrazolylthio)-hydroquinone,

DIRH-3: 2-n-octadecylthio-5-(1-phenyl-5-tetrazolylthio)hydroquinone,

DIRH-4: 3-n-octadecylthio-5-phenylthio-6-(1-phenyl-5-tetrazolylthio)hydroquinone.

The silver halide emulsion used in this invention is a colloidal dispersion of silver chloride, silver bromide, silver chlorobromide, silver iodobromide, silver chloroiodobromide, or a mixture thereof, and the composition of the silver halide is selected according to the end use or purpose of the photographic materials and the processing conditions. However, a silver iodobromide emulsion or a silver chloroiodobromide emulsion containing 1 to 10 mol% iodide, less than 30 mol% chloride, the balance being bromide, is particularly desirable. A silver halide having a mean grain size in the range of from about 0.1 micron to about 2 microns is very useful, and, further, a silver halide having uniform grain size is sometimes preferred according to the use of the photohraphic material. The silver halide grains may be of the cubic, octahedral or mixed grain type.

The silver halide emulsions can be prepared by any conventional technique as described in, for example, P. Glafkides, Chimie Photographique, 2nd Edition, Paragraphs 18 to 23, published in 1957 by Paul Montel, Paris. For example, a water soluble silver salt such as silver nitrate is reacted with a water soluble halide such as potassium bromide in an aqueous solution of protective colloid such as gelatin and the silver halide crystals thus formed are ripened in the presence of a silver halide solvent such as a water soluble halides, for example, potassium bromide which is present in an amount more than equivalent to silver nitrate for ripening when the silver halide is silver bromide, or ammonia. A single jet, double jet, or a pAg controlled double jet method may be employed for forming the silver halide. Soluble salts formed can be removed from the silver halide emulsion by cooling to coagulate the emulsion followed by washing, by dialysis, by adding thereto an anionic polymer or an anionic surface active agent having a sulfo group, a sulfuric ester group, or a carboxyl group as a precipitating agent followed by controlling the pH thereof, or by using an acylated protein such as phthaloylated gelatin as the protective colloid and precipitating the salt by pH control.

It is preferred that the silver halide emulsion used in this invention be chemically sensitized by heating the silver halide emulsion in the presence of a natural sensitizer contained in the gelatin used in the emulsion as the protective colloid, a sulfur sensitizer such as sodium thiosulfate and N,N'-trimethylthiourea, a gold sensitizer such as a thiocyanate complex salt of monovalent gold and a thiosulfate complex salt of a monovalent gold, or a reducing sensitizer such as stannous chloride and hexamethylene tetramine.

In this invention, a silver halide emulsion of this type which readily forms latent image on the surface of the silver halide grains as well as a silver halide emulsion of the type which easily forms latent image in the interior of silver halide grains as described in U.S. Pat. Nos. 2,592,550 and 3,206,313 can also be used.

The silver halide emulsion used in this invention may be stabilized by additives such as 4-hydroxy-6-methyl-1,3,3a7-tetraazaindene, 5-nitroimidazole, 1-phenyl-5-mercaptotetrazole, 8-chloro mercury quinoline, benzenesulfinic acid, and pyrocatechin. Furthermore, an inorganic compound such as a cadmium salt, a mercury salt, and a palladium complex is also useful for stabilization of the silver halide emulsion. Still further, the silver halide emulsion used in this invention may contain a sensitizing compound such as a polyethylene oxide compound.

Also, the silver halide emulsion used in this invention may, if desired, have its color sensitivity expanded by an optical sensitizer. Examples of useful optical sensitizers are cyanines, merocyanines, homopolar cyanines, styryls, hemicyanines, oxazoles, hemioxazoles, etc. Specific examples of optical sensitizers are described in P. Glafkides, Chimie Photographique, 2nd Edition, Paragraphs 35 - 41 and F. M. Hammer, The Cyanine Dyes and Related Compounds, (Interscience). In particular, the cyanine dye where the nitrogen atom of the nucleus is substituted by an aliphatic group having a hydroxyl group, a carboxyl group, or a sulfo group as described in U.S. Pat. Nos. 2,503,776, 3,459,553 and 3,177,210 is useful in the practice of this invention.

The photographic layers in this invention may be coated by various conventional coating methods such as, for instance, dip coating, roller coating, air knife coating, bead coating as described in U.S. Pat. No. 2,681,508, and curtain coating as described in U.S. Pat. Nos. 3,508,947 and 3,513,017. In particular, for the production of multi-layer color photographic materials, it is profitable to simultaneously form a plurality of layers using a multi-slit type hopper as described in U.S. Pat. Nos. 3,761,417, 2,761,418, 2,761,419, and 2,761,791.

In order to facilitate the coating of the photographic emulsion layers used in this invention, it is profitable to incorporate a surface active agent in the coating compositions as a coating aid. Examples of such coating aids are nonionic surface active agents such as saponin, the addition product of oxyethylene and p-nonylphenol, alkyl ethers of sucrose, and monoalkyl ethers of glycerine; anionic surface active agents such as the sodium salt of dodecylsulfuric acid, sodium p-dodecylbenzenesulfonate, and sodium dioctylsulfosuccinate; and amphoteric surface active agents such as a carboxymethyldimethyl lauryl ammonium.hydroxide internal salt, Deriphat 151 (trade name), and the betaine compounds as described in U.S. Pat. No. 3,441,413, British Pat. No. 1,159,825 and Japanese Patent Publication 21,985/1971.

Furthermore, to facilitate the coating of photographic layers in this invention, the coating compositions may further contain various viscosity-increasing agents such as, for example, a high molecular weight polyacrylamide which per se increases the viscosity of the coating composition and an anionic polymer which exhibits a viscosity increasing action by co-action with the binder polymer in the coating composition, such as cellulose sulfuric acid esters, poly-p-sulfostyrene.potassium salt, and the acrylic polymers as described in U.S. Pat. No. 3,655,407.

The processing composition used in this invention is a liquid composition containing processing components necessary for the development of silver halide emulsion layers and the formation of diffusion transfer dye images. The solvent of the liquid processing composition is normally water but it can contain, if desired, a hydrophilic solvent such as methanol, 2-methoxyethanol, etc.

Mandatory constituents of the liquid processing composition are water, at least one developing agent and at least one alkali; all other constituents are optional.

The liquid processing composition contains an alkali in an amount sufficient to maintain the pH necessary for development of the photographic emulsion layers and for neutralizing the acids formed during the steps of the development and the formation of dye images. As the alkali, conventional materials are used, e.g., sodium hydroxide, potassium hydroxide, a dispersion of calcium hydroxide, tetramethyl ammonium hydroxide, sodium carbonate, tri-sodium phosphate, diethylamine, etc. It is preferred that the liquid processing composition have a high pH higher than about 10 at room temperature. More preferably, the liquid processing composition contains a hydrophilic polymer such as high molecular weight polyvinyl alcohol, hydroxyethyl cellulose, and sodium carboxymethyl cellulose. Such a polymer preferably provides a viscosity of higher than about 1 poise, preferably of about 1,000 poises, to the liquid processing composition at room temperature to facilitate uniform spreading of the processing composition at development as well as forming a non-fluid film when the liquid processing composition is concentrated by the transfer of aqueous medium into the photosensitive element and the image receiving element at development to assist in maintaining the film unit united after processing. After the formation of the diffusion transfer dye images is substantially finished, the polymer film thus formed can serve to suppress coloring components from being further transferred into the image receiving element to prevent the discoloring of the dye images formed.

It is often profitable that the liquid processing composition contain a light absorbing material such as carbon black and a desensitizer as described in U.S. Pat. No. 3,579,333 to prevent the silver halide emulsion layers from being fogged by external light during processing.

It is advantageous that the liquid processing composition used in this invention be contained in a rupturable container, i.e., it is profitable in this invention that the container hold the liquid processing composition in a cavity formed by folding a fluid and air-impervious sheet material and sealing the end margins and that the container be so constructed that when the film unit is passed through pressure applying members and the container is ruptured at a definite position by the interior pressure applied to the processing composition contained therein to release the processing composition. Useful sheet material for forming the rupturable container includes a laminate of polyethylene terephthalate, polyvinyl alcohol, and polyethylene and a laminate of lead foil and a copolymer of vinyl chloride and vinyl acetate. It is also preferred that the container be fixed along the leading edge of the film unit so that the liquid processing composition contained therein is spread in one direction over the surface of the photosensitive element when ruptured. Preferred examples of preferably used containers in this invention are described in U.S. Pat. Nos. 2,543,181, 2,643,886, 2,653,732, 2,723,051, 3,056,491, 3,056,492 and 3,152,515.

In the following, where polymeric materials are referred to, they preferably have a viscosity of about 100 to about 1,000,000 centipoises, most preferably from 10,000 to 100,000 centipoises.

The image receiving element used in this invention preferably contains a basic polymer or a basic surface active agent. As such a basic polymer, compounds having a tertiary or quaternary nitrogen atom are useful. Specific examples of these compounds are poly-4-vinylpyridine; polymers of the aminoguanidine derivates of vinyl methyl ketone as described in U.S. Pat. No. 2,882,156; poly-4-vinyl-N-benzylpyridium.p-toluene sulfonate; poly-3-vinyl-4-methyl-N-n-butylpyridinium bromide; the copolymer of styrene and N-(3-maleimidopropyl)-N,N-dimethyl-N-4-phenylbenzyl ammonium chloride as described in British Pat. No. 1,261,925; and poly N-(2-methacryloylethyl)-N,N-dimethyl-N-benzylammonium chloride.

As basic surface active agents, a compound having an onium group such as an ammonium, sulfonium, or phosphonium group and a hydrophilic group such as a long chain alkyl group are excellent. Specific examples of basic surface active agents are N-laurylpyridinium bromide, cetyltrimethylammonium bromide, methyl-tri-n-laurylammonium.p-toluenesulfonate, methyl-ethyl-cetylsulfonium iodide, benzene-triphenyl phosphonium chloride, hexadecylmethyl ammonium chloride, N-n-octadecyltributylammonium bromide, a copolymer of styrene and N,N-dimethyl-N-benzyl-N-3-maleimidopropyl ammonium bromide, and a coacervation product of N-n-hexadecyl-N-morpholinium sulfate and methyl-tri-n-dodecylammonium-p-toluene sulfonate. Furthermore, compounds of multivalent metals such as thorium, aluminum, zirconium, etc., have a fixing action for anionic dye forming materials and are useful for forming a film together with gelatin (in particular acid processed gelatin), polyvinyl alcohol, polyacrylamide, polyvinyl methyl ether, hydroxyethyl cellulose, N-methoxymethylpolyhexylmethylene adipamide, or polyvinyl pyrrolidone.

When the dye image forming material is a dye forming component such as a diffusible coupler, the image receiving layer contains another coupling component which forms a dye by reaction with the aforesaid component, such as a p-phenylenediamine derivative and an oxidizing agent or a diazonium compound. Such image receiving elements are described in U.S. Pat. Nos. 2,647,049, 2,661,293, 2,698,244, 2,698,798, 2,802,735, 3,676,124, and British Pat. Nos. 1,158,440 and 1,157,507.

It is further preferred that the diffusion transfer color photographic film unit of this invention have a function of neutralizing alkali from the liquid processing composition used at development, that is, the liquid processing composition contains alkali to provide to the composition a high pH (of above about 10, preferably above 11) sufficient to promote image forming step comprising the development of the silver halide emulsion layers and the formation and diffusion of diffusible dye images. After the formation of the diffusion transfer dye images is substantially finished, the pH in the film unit is neutralized to below 9, preferably below 7, to prevent the further progress of the image formation and also changes of the dye images with the passage of time, whereby the occurrence of discoloring and fading of dye images and the formation of stains at blank areas caused by high pH are suppressed. For this purpose, it is profitable to provide the film unit with a neutralization layer containing an acid material in an amount sufficient to neutralize the aforesaid pH of the alkali in the processing composition used, that is, an acid material at a real concentration above the equivalents of the alkali in the processing composition spread. Preferred acid materials used for the purpose are materials containing an acid group and having a pKA of lower than about 9, in particular, a carboxyl group or a sulfo group, or further containing a precursor giving such an acid group by hydrolysis. More preferred examples of the acid materials are higher fatty acids such as oleic acid as described in U.S. Pat. No. 2,983,606 and polymers of acrylic acid, methacrylic acid, or maleic acid and the partial esters or the acid anhydrides of the polymers as described in U.S. Pat. No. 3,362,819. Also, specific examples of high molecular acid materials are copolymers of a vinyl monomer such as ethylene, vinyl acetate, vinyl methyl ether, etc., and maleic anhydride, the n-butyl half esters of copolymers of butyl acrylate and acrylic acid, and cellulose acetate acid phthalate.

The neutralization layer may further contain a polymer such as cellulose nitrate and polyvinyl acetate or further contain a plasticizer as described in U.S. Pat. No. 3,557,237 in addition to the aforesaid acid material. Moreover, the neutralization layer may be hardened by cross-linking with a polyfunctional aziridine compound, an epoxy compound, etc. The neutralization layer can be disposed in the image receiving element and/or the photosensitive element of the photographic film unit, but it is advantageous to dispose the neutralization layer between the support and the image receiving layer of the image receiving element.

Furthermore, the acid material may be incorporated in the film unit in microencapsulated form as described in German Offenlegungsschrift 2,038,254.

It is further preferred that a neutralization layer or an acid material containing layer used in this invention be isolated from the spread layer of the liquid processing composition by a neutralization rate controlling layer. The neutralization rate controlling layer acts to prevent the undesirable reduction of the density of the transferred dye images by the too rapid reduction in pH of the processing composition by the neutralization layer before the necessary development of the silver halide emulsion layer(s) and the formation of transferred dye images are performed, and also delays the reduction of the pH of the processing composition until the desired transfer of the dye images is finished.

In a preferred embodiment of this invention, the image receiving element has a multi-layer structure composed of a support, a neutralization layer, a neutralization rate controlling layer, and a mordant layer (image receiving layer). The neutralization rate controlling layer is mainly composed of a polymer such as gelatin, polyvinyl alcohol, polyvinyl propyl ether, polyacrylamide, hydroxypropylmethyl cellulose, isopropyl cellulose, partially butyrated polyvinyl alcohol, partially hydrolyzed polyvinyl acetate, a copolymer of $\beta$-hydroxyethyl methacrylate and ethyl acrylate, etc. The polymer constituting the neutralization rate controlling layer is advantageously hardened by an aldehyde compound such as formaldehyde or an N-methylol compound. It is further preferred that the thickness of the neutralization rate controlling layer be from about 2 microns to about 20 microns.

In the photosensitive element used in this invention, a dye image forming material is associated with a silver halide emulsion. According to the desired color reproduction, a combination of the color sensitivity of the silver halide emulsion and the spectral absorption of the dye image formed is properly selected. For the reproduction of natural color by a subtractive color process, a photosensitive element having at least two combinations each of a silver halide emulsion having a selective spectral sensitivity in a certain wavelength region and a compound providing a dye image having a selective spectral absorption in the same wavelength region as that of the silver halide emulsion is used. A particularly useful photosensitive element has a combination of a blue-sensitive silver halide emulsion and a compound providing a yellow dye image, a combination of a green-sensitive silver halide emulsion and a compound providing a magenta dye image, and a combination of a red-sensitive silver halide emulsion and a compound providing a cyan dye image. These combination units of the silver halide emulsions and the dye image forming materials are each coated in layers in face-to-face relationship or are each formed into particles and are coated as a mixture of the particles thereof.

In a preferred multi-layer structure, the blue-sensitive emulsion layer and the green-sensitive emulsion layer are formed in succession from the exposure side and, in particular, in the case of using highly sensitive emulsions containing iodide, a yellow filter layer is disposed between the blue-sensitive emulsion layer and the green-sensitive emulsion layer. The yellow filter layer contains a dispersion of yellow colloidal silver, a dispersion of an oil soluble yellow dye, an acid dye mordanted to a basic polymer, or a basic dye mordanted to an acid polymer. It is profitable that the silver halide emulsion layers be isolated from each other by an interlayer. The interlayer acts to prevent the occurrence of an undesirable coaction between differently color sensitized silver halide emulsion layers. The interlayer is composed of gelatin or a hydrophilic synthetic polymer such as polyacrylamide or a partially hydrolyzed product of polyvinyl acetate. Furthermore, it may be composed of a porous polymer formed from the latex of a hydrophilic polymer and a hydrophobic polymer as described in U.S. Pat. No, 3,625,685 or a polymer which increases in hydrophilicity gradually under the action of a liquid processing composition, such as calcium alginate as described in U.S. Pat. No. 3,384,483.

The interlayer may further contain an agent to suppressing the occurrence of any co-action between the silver halide emulsion layers which can be selected according to the kinds of the dye image forming materials and the liquid processing composition used. For example, in the case of using a dye image forming material of the type releasing a diffusible dye by reaction with the oxidation product of a primary aromatic amino color developing agent, a reducing agent such as a non-diffusible hydroquinone derivative and a non-diffusible coupler which can be fixed by reaction with the oxidation product of the developing agent are effective to prevent the occurrence of an undesirable conversion of the oxidation product of the developing agent between the emulsion layer units. Furthermore, performing image reversal by dissolution using physical development nuclei, it is useful, to obtain good color reproduction, that the interlayer contain physical development nuclei such as colloidal metallic silver in addition to the aforesaid materials and in performing image reversal using a development inhibitor releasing compound, it is also useful for the same purpose as above that the interlayer contains fine silver halide grains of low sensitivity.

In a preferred embodiment of this invention, the image receiving layer be disposed between a transparent support and a light reflective layer which is pervious to the liquid processing composition, the dye image formed by the development being observed through the transparent support without any need to separate the image receiving element from the photosensitive element after transfer of the dye image. Examples of film units having such a function are described in U.S. Pat. Nos. 2,983,606, 3,415,644, 3,415,645, 3,516,646, 3,594,164, and 3,594,165.

In one embodiment of non-separation type film units, the silver halide emulsion associated with a dye image forming material is coated on a light impermeable support and the photosensitive layer is image-wise exposed from the opposite side to the support. After exposure, a liquid processing composition is spread in layer form between the surface of the silver halide emulsion layer and the image receiving layer formed on a transparent support. The liquid processing composition contains therein a light reflective material and thus the dye image formed by diffusion in the image receiving layer through the layer of the liquid processing composition is observed through the transparent support. In a film unit of this type, a camera possessing a specific optical system such as a mirror reflection system is necessary to obtain a correct image.

In another embodiment of a non-separation type film unit, a silver halide emulsion layer associated with a dye image forming material is formed on a transparent support and the photosensitive layer is exposed through the support. After exposure, the liquid processing composition is spread in layer form between the surface of the silver halide emulsion layer and the image receiving layer formed on a transparent support. A layer of a light reflective material is disposed beforehand between the silver halide emulsion layer and the image receiving layer or a light reflective material is incorporated in the layer of the liquid processing composition thus spread and the dye image fixed in the image receiving layer is observed through the transparent support with the layer of the light reflective material as the background.

In still another embodiment of a non-separation type film unit, a transparent support is, in succession, coated with an image receiving layer, a light reflective layer, a shading layer containing a light absorption material, and a silver halide emulsion layer having associated therewith a dye image forming material, and the film unit is image-wise exposed from the support side. Then, a liquid processing composition is spread over the surface of the silver halide emulsion layer. The dye image diffused through the shading layer and the light reflective layer and fixed in the image receiving layer is observed through the transparent support. In a particularly useful embodiment of a film unit of this type, the surface of the silver halide emulsion layer is covered by a transparent cover sheet, the film unit is exposed through the transparent cover sheet, and a liquid processing composition containing a light absorptive material is spread between the cover sheet and the surface of the silver halide emulsion layer.

In this invention a light reflective material is used to provide a white background for dye images formed in the image receiving layer, and examples of suitable light reflective materials used in this invention are titanium dioxide, barium sulfate, zinc oxide, alumina, barium stearate, calcium carbonate silicate, zirconium oxide, kaolin, and magnesium oxide, and such can be used individually or as a mixture thereof. The light reflective material may have its own form beforehand or may be formed at a predetermined position from a precursor distributed in the film unit as described in Belgian Pat. Nos. 768,110 and 768,111. Also, the light reflective material may be incorporated in a layer of a binder such as polyvinyl alcohol, gelatin, hydroxypropyl cellulose, and polyvinyl pyrrolidone or may be incorporated in a liquid processing composition together with a film forming polymer such as hydroxyethyl cellulose, carboxymethyl cellulose, etc., so that the light reflective material is fixed in the layer of the polymer in a dispersed state when the processing composition is spread in layer form. In this case, when an optical whitening agent such as a stilbene, cumalin, triazine, or oxazole is used together with the light reflective material, a beautiful white background is obtained. Also, for protecting the silver halide emulsion layer from ambient light during processing, it is useful to incorporate in the layer a dye which is colored at a pH higher than the pKa but become colorless at a pH lower than the pKa as described in Belgian Pat. Nos. 743,336, 768,107, and 768,109 together with the light reflective material. It is profitable that the layer containing the light reflective material has a composition of a light reflective material/binder polymer ratio of about 0.5 to about 100 by weight ratio and a dry thickness of about 5 to about 50 microns and further has a light reflectance of higher than about 50%, preferably higher than 70%.

The film unit of this invention has a rupturable container containing a liquid processing composition. When the container is compressed by a pressure applying member, it is ruptured by the internal pressure thereof to release the liquid processing composition in a predetermined manner. Various mechanisms can be used as the pressure applying member in this invention but a pressure applying member composed of at least a pair of member juxtaposed with a certain interval is particularly suitable for the processing of the film unit. A pair of members are fixed with a definite interval pushing one another at a definite force by an elastic member such as a spring and the members may be rods, free rollers, or drivable rollers. When the film unit is passed through the juxtaposed pressure applying members, the container is ruptured and the liquid processing composition contained therein is released and spread in layer form between the photosensitive sheet and the image receiving sheet or between the silver halide emulsion layer and the image receiving layer of the film unit. Examples of juxtaposed pressure applying members advantageously used in this invention are described in U.S. Pat. Nos. 3,647,441 and 3,652,281.

In the film unit of this invention, development can proceed in the light outside the camera. Thus, the silver halide emulsion layer or layers of the film unit are protected from ambient light until the development and the transfer of the dye images formed are substantially finished, and for this purpose it is advantageous to dispose a shading layer containing a light absorptive material at the sides of the silver halide emulsion layer or layers.

The shading layer is permeable (hydrophilic) to the liquid processing composition or impermeable to the processing composition (dimensional stability) according to the place where the layer is disposed.

Examples of shading layers permeable to liquid processing composition are a layer of a water permeable polymer such as gelatin, polyvinyl alcohol, polyacrylamide, hydroxyethyl cellulose, carboxymethyl cellulose.sodium salt, methyl cellulose, etc., containing a shading material and the layer may be formed as a layer beforehand or may be spread as a layer of the liquid processing composition at development.

Examples of shading layers impermeable to liquid processing compositions or having dimensional stability are a polymer layer containing a light absorptive material as described in Japanese Patent Publication 24,547/1968 and U.S. Pat. No. 3,607,818, and such is disposed in the film unit as a support or a shading sheet. A dimensionally stable film used for this purpose may be formed from a metal foil such as an aluminum foil or a tin foil, a laminated film of a metal foil and a polymer sheet, or a polyethylene terephthalate film vacuum deposited with aluminum.

It is preferred, in this case, from the viewpoints of improving the shading property and providing attractive appearance, to cover the shading layer with a light reflective material such as titanium dioxide. In the shading layer, various kinds of light absorptive materials can be used but particularly useful materials are carbon powder such as carbon black, colloidal silver, an organic pigment such as an azo lake and copper phthaloycanine, a dispersion of a water insoluble azo dye, a dispersion of an anthraquinone dye, a polymer reacted with a reactive dye, and a micelle forming hydrophilic dye. It is frequently required that the shading layer have an absorbance (diffused light) above about 3, preferably above about 5, throughout the total wavelength region of from about 350 $\mu$ to about 650 $\mu$, preferably from 300 $\mu$ to 650 $\mu$, although this requirement may differ according to the purpose of the film unit. It is advantageous to use a dimensionally stable shading layer as an adhesive tape to prevent the entrance of light in the silver halide emulsion layer from the edges of the film unit and to shade the edges of the transparent support.

The invention will now be further illustrated in more detail by the following Examples. In all Examples, silver halides having a mean grain diameter of 0.8 $\mu$ were used, unless otherwise indicated. Further, the size of any catalytic nuclei was about 50 $\mu$, unless otherwise indicated.

EXAMPLE 1

A multi-layer photosensitive element was prepared by coating a transparent cellulose acetate film support (100 microns thick) with the following layers:

1. A diffusible cyan dye forming coupler layer

A layer containing $1.70 \times 10^{-3}$ mol/m$^2$ of 1-hydroxy-4-hexadecyloxy-N-ethyl-3',5'-dicarboxyl-2-naphthanilide and a dispersion of colloidal silver in gelatin (0.77 g/m$^2$ of gelatin and $3.62 \times 10^{-2}$ of silver).

2. A spacer scavenger layer

A layer containing $3.82 \times 10^{-4}$ mol/m$^2$ of a non-diffusible cyan coupler, 1-hydroxy-2-dodecylnaphthamide, $1.20 \times 10^{-4}$ mol/m$^2$ of a non-diffusible cyan coupler, 1-hydroxy-N-[(2,4-di-t-amylphenoxy)propyl]-2-naphthamide, $7.0 \times 10^{-4}$ mol/m$^2$ of 2,5-di-tertiary-octylhydroquinone, 0.51 g/m$^2$ of di-n-butyl phthalate, and 0.9 g/m$^2$ of gelatin.

3. A blue-sensitive gelatino silver iodobromide emulsion layer

A blue-sensitive gelatino silver iododromide emulsion layer (containing $1.13 \times 10^{-2}$ mol/m$^2$ of silver, 1.22 g/m$^2$ of gelatin, and 4.0 mol% of iodide and having a mean grain size of 0.8 micron) containing 0.37 mol/m$^2$ of a non-diffusible cyan coupler, 1-hydroxy-2-dodecyl naphthamide, 0.12 mol/m$^2$ of a nondiffusible cyan coupler, 1-hydroxy-N-[(2,4-di-t-amylphenoxy)-propyl[-2-naphthamide, $2.35 \times 10^{-4}$ mol/m$^2$ of 2,5-di-t-octylhydroquinone, and 1.12 g/m$^2$ of di-n-butyl phthalate.

4. A protective layer

A layer containing 0.63 g/m$^2$ of gelatin.

The multi-layer photosensitive element thus prepared was subjected to an exposure of 20 CMS with a 1 kw tungsten lamp having a color temperature of 2,854°K.

To develop the exposed photosensitive element, a developer having the composition shown below was used and the developer was contained in a processing container.

| | | |
|---|---|---|
| Water | 100 | ml |
| Ascorbic acid | 20 | ml |
| 4-Amino-3-methyl-N-ethyl-N-($\beta$-hydroxyethyl)-aniline-sulfate (monohydrate) | 2.8 | g |
| Sodium hydroxide | 3.5 | g |
| 6-Nitrobenzimidazole nitrate | 1.5 | mg |
| Hydroxyethyl cellulose-sodium salt | 3.5 | g |
| Sodium thiosulfate-pentahydrate | 0.8 | g |
| Titanium dioxide | 45.0 | g |

The preparation of the developer and the introduction thereof into the container were performed in a Freon gas atmosphere.

The processing container was prepared by folding a laminated sheet of a polyethylene film, an aluminum foil, a cellophane film, and a polyethylene film and heat-sealing the margins in such a manner that a cavity containing the developer was formed. The container thus prepared was rupturable and contained about 2 ml of the developer.

The multi-layer photosensitive element had an area of 10 cm × 8 cm and was superposed on an image receiving element having the construction described below and the same area as the photosensitive element so that the coated layers faced each other, and the processing container containing the developer was sandwiched between both elements at one edge. The processing container was then ruptured to spread the developer at a coverage of 1.0 ml per 100 cm$^2$. The reflection density of the dye image transferred to the image receiving element was then measured using a red filter (an interference filter having its spectral transmittance maximum at 645 nm, made by Nippon Shinku Kogaku K.K.) and a blue filter (an interference filter having its spectral transmittance maximum at 436 nm, made by the same company as above) respectively using a P-type densitometer (made by Fuji Photo Film Co., Ltd.).

Image receiving element A:

Image receiving element (A) was prepared by coating a transparent polyethylene terephthalate film support 100 microns thick with the following layers in the recited order:

1. Neutralization acid layer

An ethyl acetate solution of 20% by weight of the monobutyl ester (having a mean molecular weight of 100,000 and shown by the following formula) of a 1 : 1 molar copolymer of maleic anhydride and vinyl methyl ether was coated at a dry thickness of 20 microns.

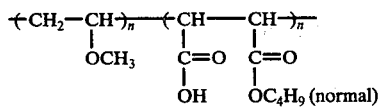

2. Neutralization rate controlling layer (spacer layer)

To a solution prepared by dissolving 54 g of a 80 : 20 molar copolymer (having a mean molecular weight of about 100,000) of 2-hydroxyethyl methacrylate and butyl methacrylate in 126 ml of a 4 : 1 volume mixture of ethanol and water were added 3 g of polyethylene glycol, a solution obtained by mixing 6 ml of an aqueous solution of 10% trimethylolmelamine and 36 ml of a 1 : 1 volume mixture of ethanol and water, and then 22.5 ml of water to form a coating composition which was coated at a dry thickness of 10 microns.

3. Image receiving layer

A coating composition prepared by dissolving 6 g of polyvinyl alcohol (having a saponification value of 98% and a polymerization degree of 1,800), 3 g of poly-4-vinylpyridine (having a molecular weight of about 70,000 to 80,000), and 7 g of poly(methacryloxyethyltriethyl ammonium.triethyl sulfate) in 150 ml of a 2.25 : 1 volume mixture of ethanol and water was coated at a dry thickness of 20 microns.

Image receiving element B:

Image receiving element (B) was prepared in the same manner in the case of preparing image receiving element (A) except that the coating composition for the neutralization rate controlling layer further contained 5 g of N-α-sulfomethylglycine (Compound (1) per 100 ml of the composition.

Image receiving element C:

Image receiving element (C) was prepared in the same manner as for preparing image receiving element (B) except that the coating composition of the neutralization rate controlling layer contained 5 g of N,N'-vic-disulfoethylene)bisglycine (Compound (2)) in place of Compound (1).

The minimum transfer densities (exposed portions) and the maximum transfer densities (unexposed portions) of the fresh dye images thus formed in the image receiving elements and those of the images allowed to stand for one day are shown in Table 1.

TABLE 1

| Image Receiving Element | Maximum Density | | | | Minimum Density | | | |
|---|---|---|---|---|---|---|---|---|
| | Fresh | | After 1 day | | Fresh | | After 1 day | |
| | R | B | R | B | R | B | R | B |
| A | 2.14 | 0.63 | 1.60 | 0.93 | 0.15 | 0.24 | 0.82 | 0.41 |
| B | 2.16 | 0.71 | 2.01 | 0.88 | 0.14 | 0.23 | 0.28 | 0.26 |
| C | 2.23 | 0.72 | 2.10 | 0.90 | 0.16 | 0.23 | 0.30 | 0.28 |

R: red density
B: blue density

The figures in the above table, that is, the change of density R in the maximum density portions, shows the fading extent of the cyan image and the change of density B shows the increase of yellow color, i.e., the yellow stain (mainly the proportion of the oxidation product of a primary aromatic amino color developing agent). Furthermore, the change of density R in the minimum density portions shows the cyan density, i.e., the extent of the post-transferred proportion (the increased amount of the dye formed by the coupling reaction of a coupler and a primary aromatic amino color developing agent oxidized by oxygen contained in air or water) and the change of density B shows the increase of the yellow stain (mainly the oxidation product of a primary aromatic amino developing agent). Therefore, as will be understood from the results shown in Table 1, in image receiving element (B) containing the compound of this invention, the fading of the cyan dye image formed was less, the proportion of the post-transfer was less, and, furhter, the formation of yellow stain was also less than those of the image receiving element (A) containing no such a compound of this invention. The results with element (C) were similar to the results with element (B).

Thus, it is clear that by the addition of the compound of this invention, the occurrence of fading and post-transfer of dye images were prevented and the formation of yellow stain was greatly reduced.

EXAMPLE 2

A multi-layer photosensitive element was prepared by successively coating a transparent cellulose acetate film support with the following layers:

1. Blue-sensitive emulsion layer

A layer containing a silver iodobromide emulsion (containing 4 mol% of iodide and $5.9 \times 10^{-2}$ mol of silver per 100 g of the emulsion) at a coverage of $8.5 \times 10^{-3}$ mol/m² of silver, 1 g/m² of gelatin, 4-hydroxy-6-methyl-1,3,3a,7-tetraazaindene at a coverage of $7 \times 10^{-3}$ g/m², sodium dodecylbenzene sulfonate at a coverage of 2.2 g/m², benzoylaceto-2-methoxy-5-tetradecyloxycarbonylacetanilide at a coverage of 0.3 g/m², 2-methylbenzoylaceto-2-chloro-5-dodecyloxycarbonylacetanilide at a coverage of 0.7 g/m², 2-methylbenzoylaceto-2-chloro-5-cetyloxycarbonylacetanilide at a coverage of 0.3 g/m², 2,5-ditert-octylhydroquinone at a coverage of $2.4 \times 10^{-2}$ g/m², and poly-p-sulfostyrene sodium salt at a coverage of $1.5 \times 10^{-2}$ g/m².

2. Interlayer

A layer containing gelatin at a coverage of 0.6 g/m², sodium dodecylbenzenesulfonate at a coverage of $1.8 \times 10^{-2}$ g/m², benzylaceto-2-chloro-5-dodecyloxycarbonylacetanilide at a coverage of 0.4 g/m², 1-(2,4,6-trichlorophenyl)-3-[α-(2,4-ditert-amylphenyloxy)ethylamido]phenylureido-5-pyrazolone at a coverage of 0.17 g/m², and poly-p-sulfoethylene sodium salt at a coverage of $2.4 \times 10^{-2}$ g/m².

3. Positive nuclei containing layer

A layer containing silver nuclei at a coverage of $3.3 \times 10^{-2}$ g/m², sodium dodecylbenzenesulfonate at a coverage of $2.2 \times 10^{-2}$ g/m², α-pivalyl-α-(3-octadecylcarbamylphenylthio)-3,5-di-carboxyacetanilide at a coverage of 0.13 g/m², and α-pivalyl-α-(4-octadecyloxycarbonylphenyloxy)-3,5-dicarboxyacetanilide at a coverage of 1.19 g/m² in a gelatin medium at a coverage of 0.8 g/m² of gelatin.

4. A yellow filter layer (barrier layer)

A layer containing yellow Carey Lea type silver at a coverage of $1.0 \times 10^{-2}$ g/m², silver nuclei at a coverage of $0.8 \times 10^{-4}$ g/m², sodium dodecylbenzenesulfonate at a coverage of $2.3 \times 10^{-2}$ g/m², benzoylaceto-2-chloro-5-dodecyloxycarbonylacetanilide at a coverage of $5.1 \times 10^{-1}$ g/m², 1-(2,4,6-trichlorophenyl)-3-[α-(2,4-ditert-amylphenyloxy)ethylamido]phenylureido-5-pyrazolone at a coverage of 0.22 g/m², poly-p-sulfostyrene sodium salt at a coverage of 0.8 g/m², and 2,4-dichloro-6-hydroxy-1,3,5-triazine sodium salt at a coverage of 0.8 g/m².

5. Positive nuclei containing layer

A layer containing silver nuclei at a coverage of 2.3 $\times 10^{-2}$ g/m², sodium dodecylbenzenesulfonate at a coverage of 1.5 $\times 10^{-2}$ g/m², 1-(2,4,6-trichloro)-3-(3,5-dicarboxybenzamino)-4-(3-octadecylcarbamylphenylthio)-5-pyrazolone at a coverage of 1.16 g/m², poly-p-sulfostyrene sodium salt at a coverage of 2.1 $\times 10^{-2}$ g/m², and 2,4-dichloro-6-hydroxy-1,3,5-triazine sodium salt at a coverage of 1.0 $\times 10^{-2}$ g/m².

6. Interlayer

A layer containing gelatin at a coverage of 0.6 g/m², sodium dodecylbenzenesulfonate at a coverage of 1.8 $\times 10^{-2}$ g/m², benzoylaceto-2-methoxy-5-tetradecyloxycarbonylacetanilide at a coverage of 0.15 g/m², 2-methylbenzoylaceto-2-chloro-5-dodecyloxycarbonylacetanilide at a coverage of 0.3 g/m², 2-methylbenzoylaceto-2-chloro-5-cetyloxycarbonylacetanilide at a coverage of 0.15 g/m², and poly-p-sulfostyrene sodium salt at a coverage of 2.4 $\times 10^{-2}$ g/m².

7. Green-sensitive emulsion layer

A layer containing a silver iodobromide emulsion (containing 4 mol% of iodide and 5.9 $\times 10^{-2}$mols of silver per 100 g of the emulsion) at a coverage of 9.7 $\times 10^{-5}$ mol/m² of silver and at a coverage of 1.4 g/m² of gelatin, the spectral sensitizing dye having the formula:

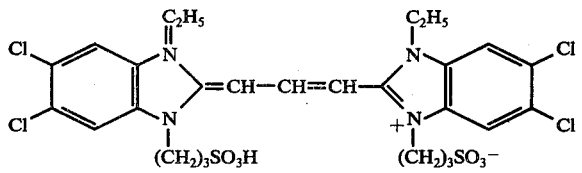

at a coverage of 1.3 $\times 10^{-3}$ g/m², the spectral sensitizing dye having the following formula:

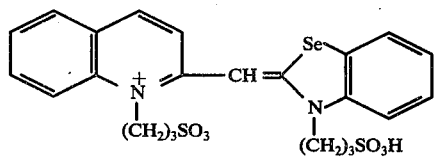

at a coverage of 4.9 $\times 10^{-4}$ g/m², 4-hydroxy-6-methyl-1,3,3a,7-tetraazaindene at a coverage of 8.2 $\times 10^{-3}$ g/m², and sodium dodecylbenzenesulfonate at a coverage of 2.5 $\times 10^{-2}$ g/m².

8. Interlayer

A layer having the same composition as interlayer 6.

9. Positive nuclei containing layer

A layer having the same composition as positive nuclei containing layer 5.

10. Barrier layer

A layer containing silver nuclei at a coverage of 3.3 $\times 10^{-2}$ g/m², sodium dodecylbenzenesulfonate at a coverage of 2.1 $\times 10^{-2}$ g/m², benzoylaceto-2-chloro-5-dodecyloxycarbonylacetanilide at a coverage of 0.5 g/m², 1-(2,4,6-trichlorophenyl)-3-[α-(2,4-di-tert-amylphenoxy)ethylamido]phenylureido-5-pyrazolone at a coverage of 0.21 g/m², poly-p-sulfostyrene sodium salt at a coverage of 2.9 $\times 10^{-2}$ g/m², and 2,4-dichloro-6-hydroxy-1,3,5-triazine sodium salt of a coverage of 2.9 $\times 10^{-2}$ g/m².

11. Positive nuclei containing layer

A layer containing silver nuclei at a coverage of 2.3 $\times 10^{-2}$ g/m², sodium dodecylbenzenesulfonate at a coverage of 1.5 $\times 10^{-2}$ g/m², 1-hydroxy-4-hexadecyloxy-N-ethyl-3',5'-dicarboxy-2-naphthanilide at a coverage of 0.9 g/m², poly-p-sulfostyrene sodium salt at a coverage of 2 $\times 10^{-2}$ g/m², and 2,4-dichloro-6-hydroxy-1,3,5-triazine sodium salt at a coverage of 3 $\times 10^{-2}$ g/m².

12. Interlayer

A layer having the same composition as interlayer 2.

13. Red-sensitive emulsion layer

A layer containing a silver iodobromide emulsion (containing 4 mol% of iodide and 5.9 $\times 10^{-2}$ mol of silver per 100 g of the emulsion) at a coverage of 1.0 $\times 10^{-3}$ mol/m² of silver at a coverage of 1.4 g/m² of gelatin, the spectral sensitizing dye having the formula:

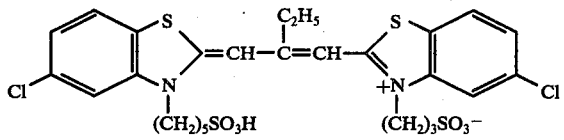

at a coverage of 9 $\times 10^{-4}$ g/m², the spectral sensitizing dye having the formula:

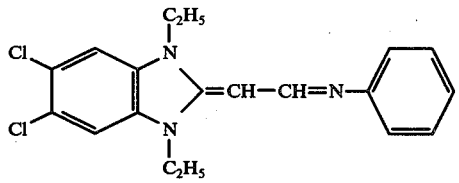

at a coverage of 6 $\times 10^{-4}$ g/m², 4-hydroxy-6-methyl-1,3,3a,7-tetrazaindene at a coverage of 9 $\times 10^{-3}$ g/m², sodium dodecylbenzenesulfonate at a coverage of 2.7 $\times 10^{-2}$ g/m², benzoylaceto-2-chloro-5-dodecylcarbonylacetanilide at a coverage of 0.9 g/m², 1-(2,4,6-trichlorophenyl)-3-[α-(2,4-di-tert-amylphenoxy)ethylamido]phenylureido-5-pyrazolone at a coverage of 0.4 g/m², 2,4-di-tert-octylhydroquinone at a coverage of 0.9 g/m², and poly-p-sulfostyrene at a coverage of 1.8 $\times 10^{-2}$ g/m².

14. Interlayer

A layer having the same composition as that of interlayer 2.

15. Positive nuclei containing layer

A layer having the same composition as that of layer 11.

The multi-layer photosensitive element thus prepared was subjected to an exposure of 20 CMS by a 1 kw tungsten lamp having a color temperature of 2854° K. Then, using a developer having the same composition as that of the developer used in Example 1 and image receiving elements having the same structures as image receiving elements A, B and C used in Example 1, the exposed photosensitive element was superposed on the image receiving element with an interval of about 250 microns therebetween and the developer spread between both elements in an amount of 2.5 ml/100 cm² using a container as in Example 1. After development was finished, the reflection densities of the dye images transferred to the image receiving element were measured using red, green, and blue filters (interference filters having the spectral transmittance maximum at 645 nm, 546 nm and 436 nm, respectively, made by Nippon Shinku Kogaku K.K.). Density measurements were made using a P-type densitometer made by Fuji Photo Film Co., Ltd. The minimum transfer densities and the maximum transfer densities of the fresh dye images and those after 1 day are shown in Table 2.

TABLE 2

| Image Receiving Element | Maximum Density | | | | | | Minimum Density | | | | | |
|---|---|---|---|---|---|---|---|---|---|---|---|---|
| | Fresh | | | After 1 Day | | | Fresh | | | After 1 Day | | |
| | R | G | B | R | G | B | R | G | B | R | G | B |
| A | 1.48 | 1.30 | 1.40 | 0.70 | 1.92 | 2.01 | 0.20 | 0.28 | 0.30 | 0.53 | 0.99 | 0.70 |
| B | 1.53 | 1.35 | 1.52 | 1.31 | 1.52 | 1.55 | 0.21 | 0.27 | 0.29 | 0.42 | 0.43 | 0.37 |
| C | 1.57 | 1.48 | 1.60 | 1.42 | 1.54 | 1.70 | 0.23 | 0.29 | 0.25 | 0.38 | 0.43 | 0.51 |

Where R and B are as in Table 1 and G = green density

In the figures shown in Table 2, the changes of densities R, G, and B in the maximum density portions mainly show the fading extent of the cyan, magenta, and yellow dye images, respectively, and the changes of the densities R, G, and B in the minimum density protions mainly show the post-transfer extent of the cyan, magenta, and yellow dyes, respectively. Furthermore, the change of density B also shows the increase of yellow stain.

It is clear from the results shown in Table 2 that in the case of using a multi-layer photosensitive element of the type as described in Example 2, the occurrence of fading of dye images and post-transfer of the dye images were substantially prevented as in Example 1.

While the invention has been described in detail and with reference to specific embodiments thereof, it will be apparent to one skilled in the art that various changes and modifications can be made therein without departing from the spirit and scope thereof.

What is claimed is:

1. In a diffusion transfer color photographic material including a photosensitive element comprising at least one silver halide emulsion layer having associated therewith a non-diffusible dye image forming material, an image-receiving element which fixes a diffusible dye formed from said dye image forming material by the oxidative reaction thereof with a primary aromatic amino color developing agent to form a dye image, and a liquid processing composition for developing the exposed photosensitive element and transferring the dye image formed into the image receiving element, the improvement which comprises including in the photosensitive element, the image receiving element, or the liquid processing composition at least one N-α-sulfoalkylated amino acid represented by the following general formula:

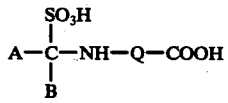

wherein A represents a hydrogen atom, a hydroxy group, a lower alkyl group having 1 to 5 carbon atoms, an alkyl group having 1 to 5 carbon atoms substituted with a hydroxy group or lower alkoxy group, an alicyclic hydrocarbon group, an aryl group or an aryl group substituted by a lower alkyl group, nitro group, cyano group, alkoxy group, sulfo group, allyloxy group, halogen atom, acyloxy group or alkoxycarbonyl group, B represents a hydrogen atom or the group

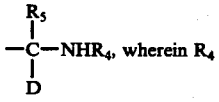

wherein $R_4$ represents a hydrogen atom, an alkyl group, an aryl group, an aryl group substituted with a sulfo group or carboxy group, $R_5$ represents a hydrogen atom or a lower alkyl group, and D represents a hydrogen atom or a sulfo group, and Q represents a methylene group, a methylene group substituted with a lower alkyl group, hydroxyalkyl group, lower alkoxyalkyl group, aralkyl group, or aryl group, a phenylene group, and a phenylene group substituted with a lower alkyl group, halogen atom, nitro group, lower alkoxy group, sulfo group or carboxy group.

2. The diffusion transfer color photographic material as set forth in claim 1, wherein the alicyclic hydrocarbon group of said A is cyclohexyl group and the aryl group of said A is phenyl group.

3. The diffusion transfer color photographic material as set forth in claim 2, wherein said N-α-sulfoalkylated amino compound is

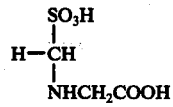

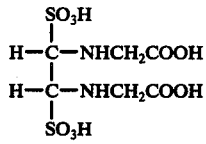

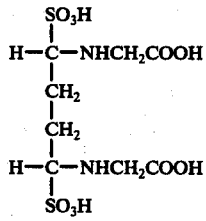

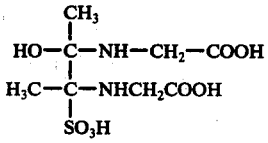

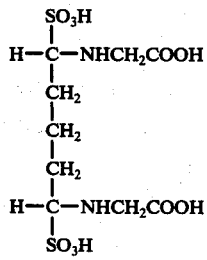

-continued
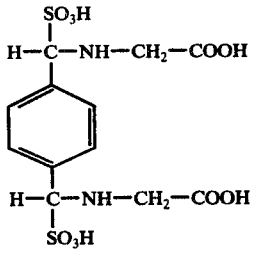
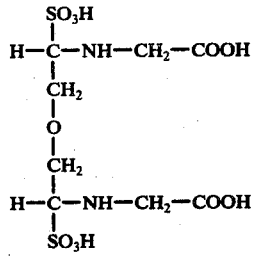
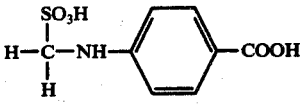
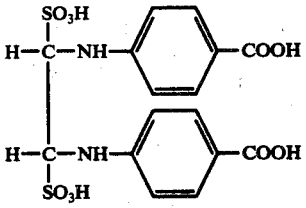
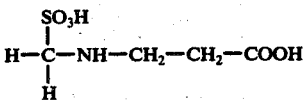
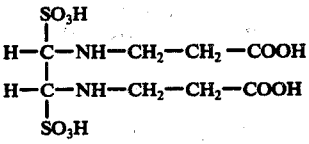
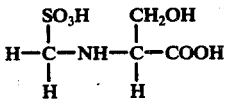
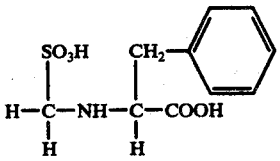
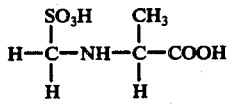
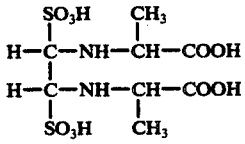
-continued
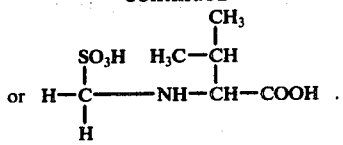
4. The diffusion transfer color photographic material as set forth in claim 3, wherein said N-α-sulfoalkylated amino acid is
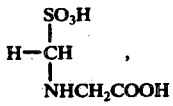
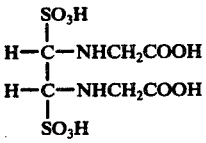
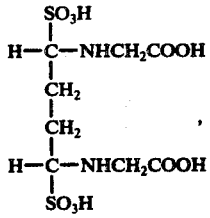
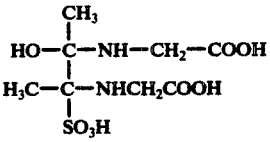
or
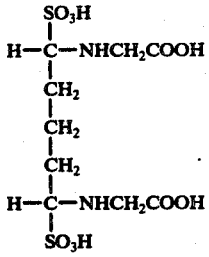
5. The diffusion transfer color photographic material as set forth in claim 3 in which said compound represented by the general formula is:
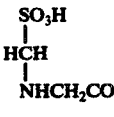
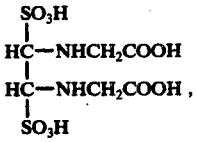
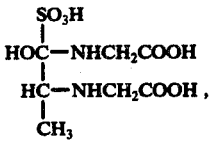
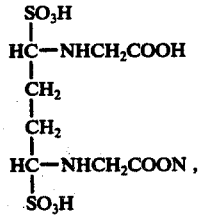
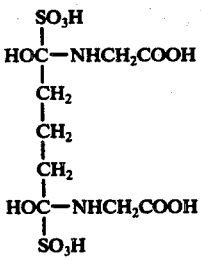
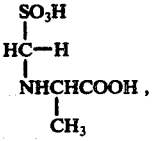

-continued

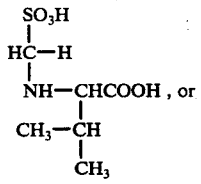

, or

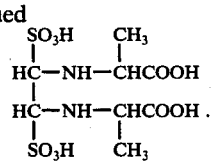

.

6. The diffusion transfer color photographic material as set forth in claim 1 in which said N-α-sulfoalkylated amino acid is incorporated in the image receiving element.

7. The diffusion transfer color photographic material as set forth in claim 6 in which said N-α-sulfoalkylated amino acid is incorporated in at least one of an image receiving layer, a neutralization speed controlling layer, or a neutralization layer constituting said image receiving element.

8. The diffusion transfer color photographic material as set forth in claim 7 in which said N-α-sulfoalkylated amino acid is incorporated in said neutralization speed controlling layer.

9. The diffusion transfer color photographic material as set forth in claim 6 in which said at least one N-α-sulfoalkylated amino acid is incorporated in the image receiving element in an amount of larger than about $10^{-3}$ mol/m$^2$.

10. The diffusion transfer color photographic material as set forth in claim 6 in which said at least one N-α-sulfoalkylated amino acid is incorporated in the image receiving element in an amount of from about $10^{-3}$ mol/m$^2$ to about $10^2$ mol/m$^2$.

11. The diffusion transfer color photographic element as set forth in claim 1 in which said photosensitive element comprises a transparent support having coated thereon (I) a blue-sensitive emulsion layer unit comprising a blue-sensitive silver halide emulsion layer containing a non-diffusible coupler forming a non-diffusible yellow dye and a non-photosensitive colloid layer adjacent the silver halide emulsion layer, said colloid layer containing a non-diffusible coupler forming a diffusible yellow dye; (II) a green-sensitive emulsion layer unit comprising a green-sensitive silver halide emulsion layer containing a non-diffusible coupler forming a non-diffusible magenta coupler and a non-photosensitive colloid layer adjacent the silver halide emulsion layer, said colloid layer containing a non-diffusible coupler forming a diffusible magenta dye, and (III) a red-sensitive emulsion layer unit comprising a red-sensitive silver halide emulsion layer containing a non-diffusible coupler forming a non-diffusible cyan dye and a non-photosensitive colloid layer adjacent the silver halide emulsion layer, said colloid layer containing a non-diffusible coupler forming a diffusible cyan dye, and either said non-photosensitive colloid layers containing spontaneously reduceable metal salts and said silver halide emulsion layers containing development inhibitor releasing compounds or said non-photosensitive colloid layers containing physical development nuclei and the liquid processing composition containing silver-halide solvent.

12. The diffusion transfer color photographic material as set forth in claim 11 in which said (I) blue-sensitive emulsion layer unit, (II) green-sensitive emulsion layer unit, and (III) red-sensitive emulsion layer unit are disposed in this order from the image-wise exposure side.

13. The diffusion transfer color photographic material as set forth in claim 11 in which said (I) blue-sensitive emulsion layer unit, (III) red-sensitive emulsion layer unit, and (II) green-sensitive emulsion layer unit are disposed in this order from the image-wise exposure side.

14. The diffusion transfer color photographic material as set forth in claim 11 in which a yellow filter layer is disposed between the blue-sensitive emulsion layer unit and other emulsion layer unit.

15. The diffusion transfer color photographic material as set forth in claim 11 in which said photosensitive element comprises at least one silver halide emulsion layer and a non-photosensitive colloid layer adjacent said silver halide emulsion layer, said silver halide emulsion layer containing a non-diffusible compound releasing a diffusible development inhibitor by the reaction with the oxidation product of a primary aromatic amino color developing agent and said non-photosensitive colloid layer containing a dispersion of a sparingly water soluble spontaneously reducible silver salt together with a coupler forming a diffusible dye.

16. The diffusion transfer color photographic material as set forth in claim 15 in which said compound releasing a development inhibitor is a development inhibitor releasing coupler.

17. The diffusion transfer color photographic material as set forth in claim 16 in which said development inhibitor releasing coupler has an arylthio group, a heterocyclic thio group, or an N-bentriazolyl group as a substituent at the coupling reactive position thereof.

18. The diffusion transfer color photographic material as set forth in claim 15 in which said compound releasing a development inhibitor is a development inhibitor releasing hydroquinone.

19. The diffusion transfer color photographic material as set forth in claim 18 in which said development inhibitor releasing hydroquinone is a hydroquinone nucleus substituted by a heterocyclic thio group.

20. The diffusion transfer color photographic material as set forth in claim 11 in which said at least one N-α-sulfoalkylated amino acid includes a compound represented by the formulae:

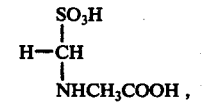

,

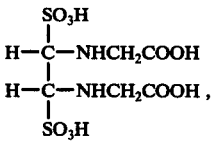

,

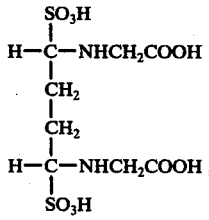

,

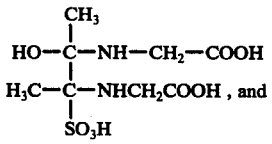

, and

-continued

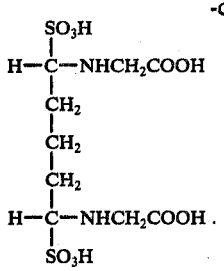

21. In a diffusion transfer color photographic process which comprises (1) imagewise exposing a photosensitive element comprising at least one silver halide emulsion layer having associated therewith a non-diffusible dye image forming material which by the oxidative reaction thereof with a primary aromatic amino color developing agent releases a diffusible dye, (2) developing said photosensitive element upon contact with a liquid processing composition in the presence of said color developing agent thereby to form the diffusible dye image and (3) transferring said diffusible dye image to an image receiving element superimposed with said photosensitive element, the improvement wherein said photosensitive element, said image receiving element or said liquid processing composition contains at least one N-α-sulfoalkylated amino acid represented by the following general formula:

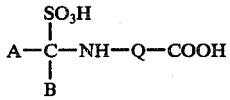

wherein A represents a hydrogen atom, a hydroxy group, a lower alkyl group having 1 to 5 carbon atoms, an alkyl group having 1 to 5 carbon atoms substituted with a hydroxy group or lower alkoxy group, an alicyclic hydrocarbon group, an aryl group or an aryl group substituted by a lower alkyl group, nitro group, cyano group, alkoxy group, sulfo group, allyloxy group, halogen atom, acyloxy group or alkoxycarbonyl group, B represents a hydrogen atom or the group

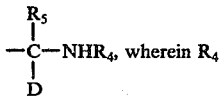

represents a hydrogen atom, an alkyl group, an aryl group, an aryl group substituted with a sulfo group or carboxy group, $R_5$ represents a hydrogen atom or a lower alkyl group, and D represents a hydrogen atom or a sulfo group, and Q represents a methylene group, a methylene group substituted with a lower alkyl group, hydroxyalkyl group, lower alkoxyalkyl group, aralkyl group or aryl group, an phenylene group, and a phenylene group substituted with a lower alkyl group, halogen atom, nitro group, lower alkoxy group, sulfo group or carboxy group.

22. The diffusion transfer color photographic process as set forth in claim 21, wherein the alicyclic hydrocarbon group of said A is cyclohexyl group and the aryl group of said A is phenyl group.

23. The diffusion transfer color photographic process as set forth in claim 22, wherein said N-α-sulfoalkylated amino compound is

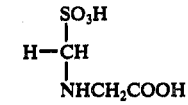

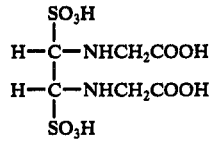

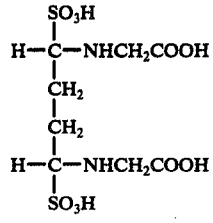

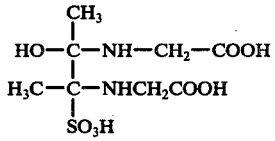

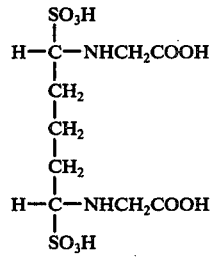

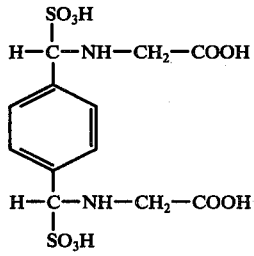

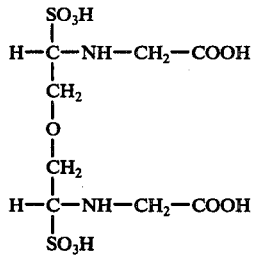

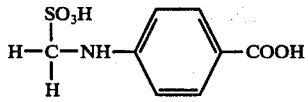

-continued

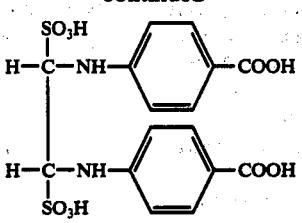

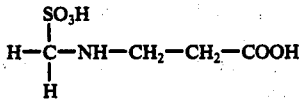

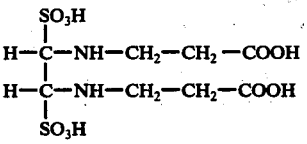

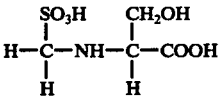

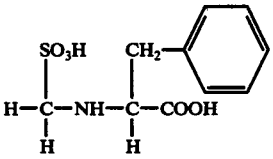

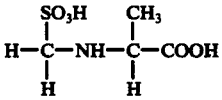

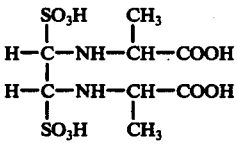

or 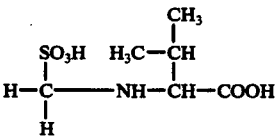

24. The diffusion transfer color photographic process as set forth in claim 23, wherein said N-α-sulfoalkylated amino acid is

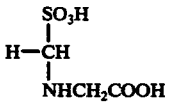

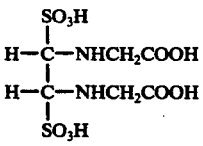

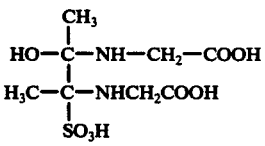

-continued

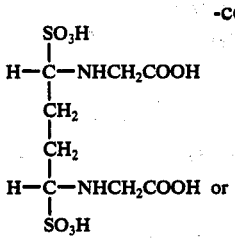

or

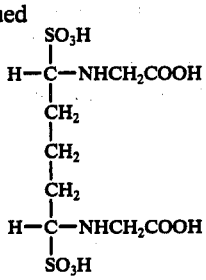

25. The diffusion transfer color photographic process as set forth in claim 21 in which said N-α-sulfoalkylated amino acid is incorporated in the image receiving element.

26. The diffusion transfer color photographic process as set forth in claim 25, in which said N-α-sulfoalkylated amino acid is incorporated in at least one of an image receiving layer, a neutralization speed controlling layer, or a neutralization layer constituting said image receiving element.

27. The diffusion transfer color photographic process as set forth in claim 26 in which said N-α-sulfoalkylated amino acid is incorporated in said neutralization speed controlling layer.

28. The diffusion transfer color photographic process as set forth in claim 26 in which said at least one N-α-sulfoalkylated amino acid is incorporated in the image receiving element in an amount of larger than about $10^{-3}$ mol/m$^2$.

29. The diffusion transfer color photographic process as set forth in claim 26 in which said at least one N-α-sulfoalkylated amino acid is incorporated in the image receiving element in an amount of from about $10^{-3}$ mol/m$^2$ to about $10^2$ mol/m$^2$.

30. The diffusion transfer color photographic process as set forth in claim 21 in which said photosensitive element comprises a transparent support having coated thereon (I) a blue-sensitive emulsion layer unit comprising a blue-sensitive silver halide emulsion layer containing a non-diffusible coupler forming a non-diffusible yellow dye and a non-photosensitive colloid layer adjacent the silver halide emulsion layer, said colloid layer containing a non-diffusible coupler forming a diffusible yellow dye; (II) a green-sensitive emulsion layer unit comprising a green-sensitive silver halide emulsion containing a non-diffusible coupler forming a non-diffusible magenta coupler and a non-photosensitive colloid layer adjacent the silver halide emulsion layer, said colloid layer containing a non-diffusible coupler forming a diffusible magenta dye, and (III) a red-sensitive emulsion layer unit comprising a red-sensitive silver halide emulsion layer containing a non-diffusible coupler forming a non-diffusible cyan dye and a non-photosensitive colloid layer adjacent the silver halide emulsion layer, said colloid layer containing a non-diffusible coupler forming a diffusible cyan dye, and either said non-photosensitive colloid layers containing spontaneously reduceable metal salts and said silver halide emulsion layers containing development inhibitor releasing compounds or said non-photosensitive colloid layers containing physical development nuclei and the liquid processing composition containing silver-halide solvent.

31. The diffusion transfer color photographic process as set forth in claim 30 in which said (I) blue-sensitive emulsion layer unit, (II) green-sensitive emulsion layer unit, and (III) red-sensitive emulsion layer unit are disposed in this order from the image-wise exposure side.

32. The diffusion transfer color photographic process as set forth in claim 30 in which said (I) blue-sensitive emulsion layer unit, (III) red-sensitive emulsion layer unit, and (II) green-sensitive emulsion layer unit are disposed in this order from the image-wise exposure side.

33. The diffusion transfer color photographic process as set forth in claim 30 in which a yellow filter layer is disposed between the blue-sensitive emulsion layer unit and other emulsion layer unit.

34. The diffusion transfer color photographic process as set forth in claim 31 in which each of said silver halide emulsion layers contain a non-diffusible compound releasing a diffusible development inhibitor by the reaction with the oxidation product of a primary aromatic amino color developing agent and each of said non-photosensitive colloid layers contain a dispersion of a sparingly water soluble spontaneously reducible silver salt together with a coupler forming a diffusible dye.

35. The diffusion transfer color photographic process as set forth in claim 34 in which said compound releasing a development inhibitor is a development inhibitor releasing coupler.

36. The diffusion transfer color photographic process as set forth in claim 35 in which said development inhibitor releasing coupler has an arylthio group, a heterocyclic thio group, or an N-bentriazolyl group as a substituent at the coupling reactive position thereof.

37. The diffusion transfer color photographic process as set forth in claim 34 in which said compound releasing a development inhibitor is a development inhibitor releasing hydroquinone.

38. The diffusion transfer color photographic process as set forth in claim 37 in which said development inhibitor releasing hydroquinone is a hydroquinone nucleus substituted by a heterocyclic thio group.

* * * * *